United States Patent [19]

Sumida et al.

[11] Patent Number: 4,671,644

[45] Date of Patent: Jun. 9, 1987

[54] ELECTROSTATIC COPYING APPARATUS WITH OPENABLE HOUSING

[75] Inventors: Yasuji Sumida, Kitakatsuragi; Hiroshi Kajita, Kobe; Tadashi Fujioka, Toyonaka, all of Japan

[73] Assignee: Mita Industrial Co., Ltd., Osaka, Japan

[21] Appl. No.: 793,094

[22] Filed: Oct. 30, 1985

[30] Foreign Application Priority Data

| | | | |
|---|---|---|---|
| Oct. 30, 1984 | [JP] | Japan | 59-226719 |
| Nov. 30, 1984 | [JP] | Japan | 59-251565 |
| Nov. 30, 1984 | [JP] | Japan | 59-251567 |
| Mar. 30, 1985 | [JP] | Japan | 60-64982 |
| Jul. 9, 1985 | [JP] | Japan | 60-149176 |

[51] Int. Cl.[4] ..... G03G 15/00

[52] U.S. Cl. ..... 355/3 R; 355/3 SH

[58] Field of Search ..... 355/3 R, 3 DR, 3 SH, 355/14 SH, 8

[56] References Cited

U.S. PATENT DOCUMENTS

| | | | |
|---|---|---|---|
| 4,165,168 | 8/1979 | Baumann et al. | 355/3 R |
| 4,432,639 | 2/1984 | Saitou et al. . | |
| 4,453,819 | 6/1984 | Wada et al. . | |
| 4,487,506 | 12/1984 | Repp et al. . | |

FOREIGN PATENT DOCUMENTS

| | | | |
|---|---|---|---|
| 56-123556 | 9/1981 | Japan | 355/14 SH |

*Primary Examiner*—Arthur T. Grimley
*Assistant Examiner*—J. Pendegrass
*Attorney, Agent, or Firm*—Wenderoth, Lind & Ponack

[57] ABSTRACT

An electrostatic copying apparatus which can form an image on both surfaces of a copying paper as required. The apparatus includes a copying paper conveying passage, a copying paper feeding means for feeding a copying paper sheet to the paper conveying passage, a conveyance controlling means disposed adjacent to the downstream end of the paper conveying passage, a copying paper discharging passage extending from its upstream end adjacent to the downstream end of the conveyance controlling means, a copying paper reversing passage extending from its upstream end adjacent to the downstream end of the conveyance controlling means, a copying paper returning passage extending from its upstream end adjacent to the upstream end of the conveyance controlling means, a copying paper re-feeding passage, and a copying paper re-sending means for re-sending a copying paper returned through the paper returning passage to the paper conveying passage through the paper re-feeding passage.

21 Claims, 18 Drawing Figures

ELECTROSTATIC COPYING APPARATUS WITH OPENABLE HOUSING

BACKGROUND OF THE INVENTION

1. Field of the Invention

This invention relates to an electrostatic copying apparatus, more specifically to an electrostatic copying apparatus which, as required, can form an image on both surfaces of a copying paper sheet.

2. Description of the Prior Art

It is frequently desired to form an image on both surfaces of a copying paper sheet for saving copying papers and reduce the number of documents to be preserved. This desire has been achieved in recent years by the development of an electrostatic copying apparatus of the type adapted for forming an image on both surfaces of a copying paper sheet as required.

A typical example of such an electrostatic copying apparatus includes a copying paper conveying passage, a copying paper feeding means for feeding a copying paper sheet to the paper conveying passage, a conveyance controlling means disposed adjacent to the downstream end of the paper conveying passage, a copying paper discharging passage extending from its upstream end adjacent to the downstream end of the conveyance controlling means, a copying paper reversing passage extending from its upstream end adjacent to the downstream end of the conveyance controlling means, a copying paper returning passage extending from its upstream end adjacent to the upstream end of the conveyance controlling means, a copying paper re-feeding passage, and a copying paper re-sending means for re-sending a copying paper returned through the paper returning passage to the paper conveying passage through the paper re-feeding passage. The conveyance controlling means comprises a lower movable guide member and an upper movable guide member defining a paper moving passage therebetween. The lower and upper movable guide members are adapted to be selectively held at a first position at which the downstream end of the paper conveying passage communicates with the upstream end of the paper discharging passage and a second position at which the downstream end of the paper conveying passage communicates with the upstream end of the paper reversing passage and the upstream end of the paper reversing passage communicates with the upstream end of the paper returning passage.

In this type of electrostatic copying apparatus, an image is formed on one surface of a copying paper sheet while it is conveyed through the paper conveying passage after being fed thereto from the paper feeding means. When it is desired to form an image only on one surface of the sheet, the sheet having one image formed on it is introduced into the paper discharging passage through the paper moving passage defined between the lower and upper movable guide members held at the first position, and then discharged through the paper discharging passage. On the other hand, when it is desired to form an image on both surfaces of an image, the aforesaid copying paper bearing an image on one surface is then introduced into the paper reversing passage through the paper moving passage defined between the lower and upper movable guide members held at the second position. After the trailing end of the paper sheet has passed the downstream end of the paper conveying passage, the moving direction of the paper sheet is reversed, and the sheet is introduced into the paper returning passage. The paper sheet is returned to the paper re-sending means through the paper returning passage. The sheet is re-fed to the paper conveying passage through the paper re-feeding passage from the paper re-sending means. During re-conveyance of the sheet through the paper conveying passage, an image is formed on the other surface of the paper. The sheet bearing an image on both surfaces is then introduced into the paper discharging passage through the paper moving passage between the lower and upper movable guide members held at the first position, and discharged through the paper discharging passage.

The aforesaid type of conventional electrostatic copying apparatus has not proved to be entirely satisfactory, and has various problems to be solved, for example with regard to the operation of removing copying paper that jams up in various passages, the structure of the apparatus on the upstream side of the conveyance controlling means (and therefore on the downstream end of the paper conveying passage and the upstream end of the paper returning passage), the structure of the apparatus on the downstream side of the conveyance controlling means (and therefore the upstream end of the paper discharging passage and the upstream end of the paper reversing passage), and the structure of the paper returning passage.

SUMMARY OF THE INVENTION

It is a general object of this invention to provide a novel and excellent electrostatic copying apparatus having various improvements over the above-described type of conventional electrostatic copying apparatus.

Specifically, a lower front cover member is mountd on a lower supporting frame of the electrostatic copying apparatus so that it is free to move between a closed position at which it covers a greater part of the front surface of the lower supporting frame and an open position at which the front surface of the lower supporting frame is open, whereat copying paper which has jammed in a paper returning passage of the copying apparatus can be removed. A locking means prevents the lower front cover member from being moved to the open position from the closed position when an upper supporting frame of the copying apparatus is in an operating position, but permits the lower front cover member to be moved to the open position from the closed position when the upper supporting frame is pivoted from an operating position thereof to a non-operating position thereof.

Various specific objects of the invention and various specific improvements in various aspects of this invention will become apparent from the following detailed description taken in conjunction with the accompanying drawings.

DETAILED DESCRIPTION OF PREFERRED EMBODIMENTS

The invention will now be described in detail with reference to the accompanying drawings.

Figure 1:
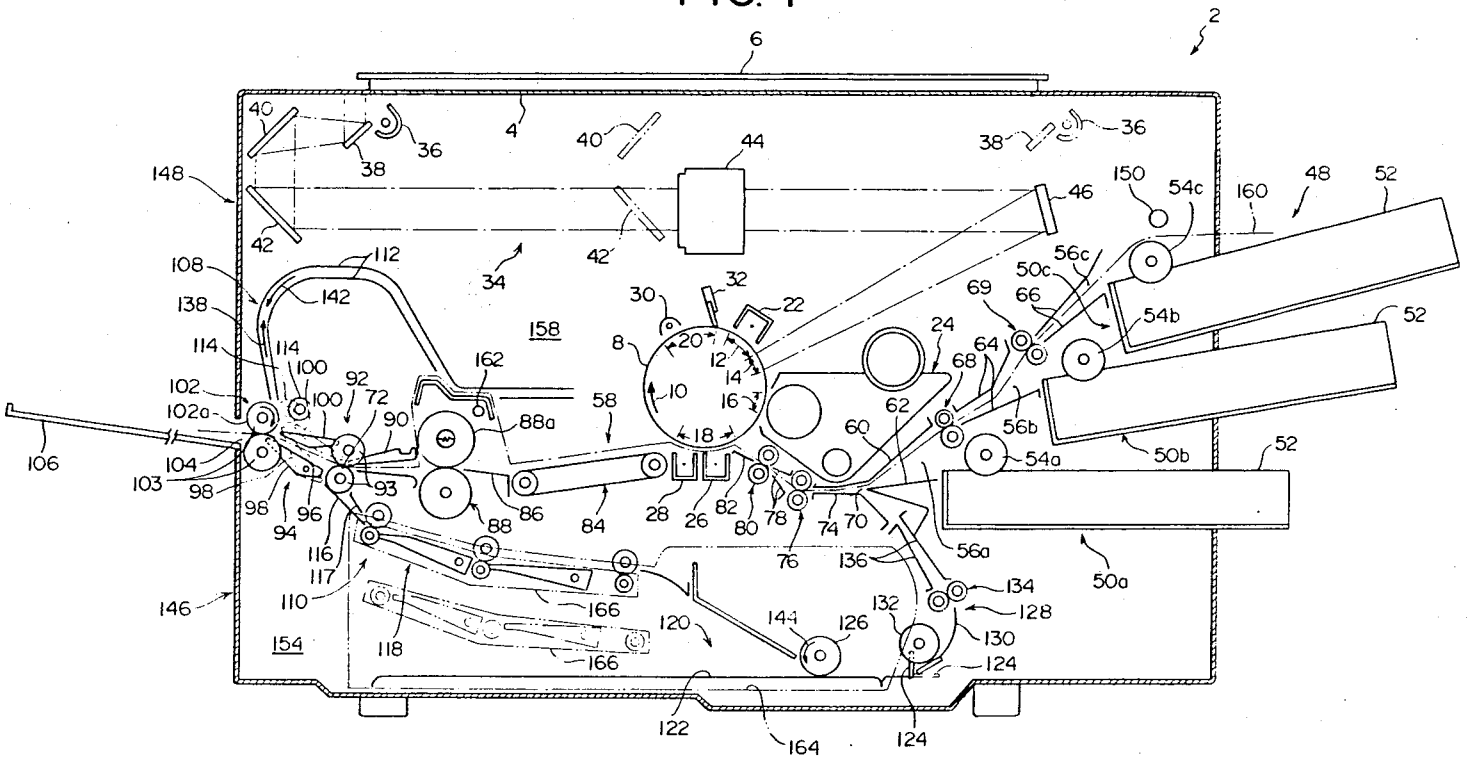
FIG. 1 is a sectional view showing in a simplified form the principal structural elements of the electrostatic copying apparatus constructed in accordance with this invention.

Outline of the general structure and operation of the electrostatic copying apparatus With reference to FIG. 1, the illustrated electrostatic copying apparatus includes a nearly rectangular housing 2. A stationary transparent plate 4 on which to place a document (not shown) to be copied and an openable document holding member 6 for covering the transparent plate 4 and the document to be placed on it are disposed on the top surface of the housing 2.

A rotating drum 8 having an electrostatographic material on its peripheral surface is rotatably mounted nearly centrally within the housing 2. Around the rotating drum 8 to be rotated in the direction shown by an arrow 10 are defined a charging zone 12, an exposing zone 14, a developing zone 16, a transferring zone 18 and a cleaning zone 20 defined in this order in the direction of arrow 10. A charging corona discharge device 22 is disposed in the charging zone 12, and a developing device 24 is disposed in the developing zone 16. A transferring corona discharge device 26 and a peeling corona discharge device 28 are provided in the transferring zone 18. In the cleaning zone 20, a charge eliminating lamp 30 and a residual toner removing blade 32 are set up.

An optical system shown generally at 34 is provided above the rotating drum 8. The optical system 34 comprises a movable document illuminating lamp 36, a first movable reflecting mirror 38, a second movable reflecting mirror 40, a third movable reflecting mirror 42, a stationary lens assembly 44 and a stationary reflecting mirror 46. During scanning exposure, the movable document illuminating lamp 36 and the first movable reflecting mirror 38 are moved at a predetermined speed V from a start-of-scan position shown by a solid line to a desired position (for example, a maximum end-of-scan position shown by a two-dot chain line) substantially horizontally. The second movable reflecting mirror 40 and the third movable reflecting mirror 42 are moved at a speed half of the above predetermined speed (V/2) from a start-of-scan position shown by a solid line to a desired position (for example, a maximum end-of-scan position shown by a two-dot chain line) substantially horizontally. During this action, the document placed on the transparent plate 4 is illuminated by the document illuminating lamp 36, and the light reflected from the document is reflected successively by the first, second and third reflecting mirrors 38, 40 and 42 and reaches the lens assembly 44. Then, it is reflected by the stationary reflecting mirror 46 and projected onto the electrostatographic material in the exposing zone 14. When the scanning exposure is over, the movable document illuminating lamp 36 and the first, second and third reflecting mirrors 38, 40 and 42 are returned to the start-of-scan positions shown by the solid lines.

In one end portion (the right end portion in FIG. 1) of the housing 2, a copying paper feeding means shown generally at 48 is provided. The paper feeding means 48 includes a lower cassette receiving section 50*a*, an intermediate cassette receiving section 50*b* and an upper cassette receiving section 50*c* for selectively and detachably receiving several types of copying paper cassettes 52 containing copying paper sheets of different sizes. Delivery rollers 54*a*, 54*b* and 54*c* for delivering the copying paper sheets one by one from the paper cassettes 52 are provided respectively in the lower, intermediate and upper cassette receiving sections 50*a*, 50*b* and 50*c*. The copying paper delivered from the paper cassette 52 mounted on the lower cassette receiving section 50*a* is introduced into a copying paper conveying passage generally shown at 58 through a copying paper delivery passage 56*a*. The copying paper delivered from the paper cassette 52 mounted on the intermediate cassette receiving section 50*b* is introduced into the paper conveying passage 58 through the paper delivery passages 56*a* and 56*a*. The copying paper delivered from the paper cassette 52 mounted on the upper cassette receiving section 50*c* is introduced into the paper conveying passage 58 through a copying paper delivery passage 56*c* and the paper delivery passages 56*b* and 56*a*. The paper delivery passage 56*a* is defined by the upstream portion of a guide plate 60 and a part of a guide plate 62. The paper delivery passage 56*b* is defined by a pair of guide plates 64. The paper delivery passage 56*c* is defined by a pair of guide plates 66. A pair of delivery rollers 68 are disposed between the upstream end of the paper delivery passage 56*a* and the downstream end of the paper delivery passage 56*b*, and a pair of delivery rollers 69, between the upstream end of the paper delivery passage 56*b* and the downstream end of the paper feed passage 56*c*.

The paper conveying passage 58 extends nearly horizontally from right to left in FIG. 1 from its upstream end 70 to its downstream end 72, and is defined by the downstream portion of the guide plate 60, the downstream portion of the guide plate 74, a pair of conveying rollers 76, a pair of guide plates 78, a pair of conveying rollers 80, a guide plate 82, the transferring zone 18 (an area between the rotating drum 8 and the transferring corona discharge device 26 and the peeling corona discharge device 28), a conveyor belt mechanism 84, a guide plate 86, pair of heat-fixing rollers 88, a pair of guide plates 90, and a pair of conveying rollers 93 in a first multifunctional conveying means generally shown at 92 (the first multifunctional conveying means will be described in detail hereinafter).

A conveyance controlling means 94 is disposed adjacent to the downstream end 72 of the paper conveying passage 58. The conveyance controlling means 94 includes a lower movable guide member 98 and an upper movable guide member 100 defining a copying paper moving passage 96 therebetween. The lower movable guide member 98 and the upper movable guide member 100 are selectively held at a lowered position shown by a solid line (a first position) and at an elevated position shown by a two-dot chain line (a second position). The conveyance controlling means 94 will be described in detail hereinafter. Downstream of the conveyance controlling means 94 is provided a copying paper discharging passage 104. At the upstream end of the paper discharging passage 104 are disposed a pair of conveying rollers 103 in a second multifunctional conveying means shown generally at 102. A receiving tray 106 is mounted detachably at the other end (i.e., the left end portion in FIG. 1) of the housing 2.

In relation to the conveyance controlling means 94, a copying paper reversing passage shown generally at 108 and a copying paper returning passage shown generally at 110 are provided. The paper reversing passage 108 is defined by a pair of guide plates 112 and extends curvilinearly from its upstream end adjacent to the downstream end of the conveyance controlling means 94. At the upstream end of the paper reversing passage 108 is disposed a pressing member 114 in the second multifunctional conveying means 102. The pressing means 114 may be constructed of a rotatable roller, and is adapted to be selectively held at a non-operating position shown by a solid line and an operating position shown by a two-dot chain line. The paper returning passage 110 extends inclinedly somewhat in a downward direction from left to right in FIG. 1 from its upstream end adjacent to the upstream end of the conveyance controlling means 94. At the upstream end of the paper returning passage 110 is disposed a guide plate 116 in the first multifunctional conveying means 92, and a guide plate 117 is provided above the downstream portion of the guide plate 116. A returning mechanism shown generally at 118 is provided downstream of the guide plates 116 and 117. The returning mechanism 118 will be described in detail hereinafter.

It will be readily understood from FIG. 1 that when the lower movable guide member 98 and the upper movable guide member 100 of the conveyance controlling means 94 are held at the lowered positions shown by solid lines, the paper conveying passage 58 and the paper discharge passage 104 are brought into communication with each other through the paper moving passage 96 in the conveyance controlling means 94. On the other hand, when the lower and upper movable guide members 98 and 100 are held at the elevated positions shown by two-dot chain lines, the paper conveying passage 58 and the paper reversing passage 108 are brought into communication with each other through the paper moving passage 96 of the controlling means 94 and at the same time, the paper reversing passage 108 and the paper returning passage 110 are brought into communication with each other through the moving passage 96 of the controlling means 94.

The illustrated electrostatic copying apparatus further includes a copying paper re-sending means shown generally at 120 below the paper returning passage 110. The paper re-sending means 120 includes a substantially horizontally exetending stand 122 for receiving copying paper, and a stopping means 124 is provided at the front end (i.e., the right end in FIG. 1) of the paper receiving stand 122. The stopping means 124 is adapted to be selectively held at an operating position shown by a solid line and a non-operating position shown by a two-dot chain line. A delivery roller 126 is provided on the front end portion of the receiving stand 122. The delivery roller 126 is mounted such that it can freely move upwardly from its illustrated position contacting the upper surface of the paper receiving stand 122, and can be elastically biased downwardly by a suitable press controlling means (not shown).

A copying paper re-feeding passage shown generally at 128 is provided which extends from the front end of the paper re-sending means 120 to the upstream end 70 of the paper conveying passage 58. The paper re-feeding passage 128 is defined by a guide plate 130, a re-feeding roller 132, a pair of re-feeding rollers 134, a pair of guide plates 136 and the upstream portion of the guide plate 74.

The outline of the operation of the electrostatic copying apparatus described hereinabove is now described.

The rotating drum 8 is rotated in the direction of arrow 10. In the charging zone 12, the surface of the electrostatographic material on the rotating drum 8 is charged to a specific polarity by the charging corona discharge device 26, and in the exposing zone 14, the image of a document placed on the transparent plate 4 is scanned, exposed and projected onto the electrostatographic material by the optical system 34 to form a latent electrostatic image on the electrostatographic material. In the developing zone 16, a toner is applied to the latent electrostatic image on the electrostatographic material by the developing device 24 to develop the latent electrostatic image to a toner image. In the transferring zone 18, a copying paper sheet conveyed through the transferring zone 18 (the conveying of copying paper will be further described hereinbelow) is brought into contact with the surface of the electrostatographic material, and by the action of the transferring corona discharge device 26, the toner image on the electrostatographic material is transferred to the copying paper sheet. Thereafter, the copying paper is peeled from the electrostatographic material by the action of the peeling corona discharge device 28. The peeled copying paper is conveyed to the pair of heat-fixing rollers 88, and during passage between the rollers 88, the toner image is fixed to the copying paper. In the meantime, in the cleaning zone 20, light from the charge eliminating lamp 30 is illuminated onto the electrostatographic material to erase the residual charge on it. The residual toner is removed from the surface of the electrostatographic material by the action of a residual toner blade 32.

The conveying of copying paper will now be described. First, with reference to the formation of an image only on one surface of a copying paper, the lower and upper movable guide members 98 and 100 of the conveyance controlling means 94 are held at the lowered positions shown by solid lines. A copying paper sheet introduced into the paper conveying passage 58 from the paper cassette 52 loaded into the lower cassette receiving section 50*a*, the intermediate cassette receiving section 50*b* or the upper cassette receiving section 50*c* is conveyed through the conveying passage 58. During this time, a toner image is transferred to the upper surface of the copying paper in the transferring zone 18, and the toner image is fixed to that surface of the copying paper by the action of the pair of heat-fixing rollers 88. As a result, an image is formed on one surface of the copying paper. The copying paper bearing an image on one surface is then introduced into the paper discharge passage 104 through the paper moving passage 96 in the conveyance controlling means 94, and discharged into the receiving tray 106 through the paper discharge passage 104. Thus, a copy having an image formed on one its one surface is obtained.

When an image is to be formed on both surfaces of copying paper, the lower and upper movable guide members 98 and 100 of the conveyance controlling means 94 are first held at the elevated positions shown by the two-dot chain lines. When the copying process is started, a copying paper introduced into the paper conveying passage 58 from the paper cassette 52 loaded into the lower cassette receiving section 50*a*, the intermediate cassette-receiving section 50*b* or the upper cassette receiving section 50*c* is conveyed through the paper conveying passage 58. During this time, a toner image is transferred to one surface (the upper surface) of the copying paper in the transfering zone 18, and fixed onto one surface of the copying paper by the action of the heat-fixing rollers 88 to form an image on one surface of the copying paper. The copying paper from the paper conveying passage 58 is introduced into the paper reversing passage 108 through the paper moving passage 96 in the conveyance controlling means 94, and advances in the direction shown by an arrow 138 through the paper reversing passage 108. When the trailing end of the copying paper has passed the downstream end of the paper conveying passage 58, i.e. the nipping site of the conveying rollers 92, the pressing means 114 in the second multifunctional conveying means 102 is held at the operating position shown by the two-dot chain line. As a result, the trailing end and the leading end of the copying paper are reversed and the copying paper is moved in the direction shown by an arrow 142. By being guided by the guide plate 116 of the first multifunctional conveying means 92, the copying paper is introduced into the paper returning passage 110. The reversing roller 114 in the paper reversing passage 108 is returned to the non-operating position shown by the solid line at a suitable time after the copying paper has been introduced into the paper returning passage 110.

The copying paper which has advanced through the paper returning passage 110 is conducted to the paper receiving stand 122 of the paper re-sending means 120 and advances on the receiving stand to the right in FIG. 1. The delivery roller 126 rotated in the direction shown by arrow 144 acts on the copying paper to deliver it further to the right and thus cause its the leading edge to abut against the stopping means 124 held at the operating position shown by the solid line. This hampers the advancing of the copying paper, and the copying paper is stopped at a desired position on the paper re-sending means 120. Even when the delivery roller 126 is rotated in the direction of arrow 144 at this time, slippage is created between the delivery roller 126 and the copying paper, and there is no further advancing of the copying paper.

When a predetermined number of copying paper sheets have been returned to the paper re-sending means 120, the lower and upper movable guide members 98 and 100 of the conveyance controlling means 94 are returned to the lowered positions shown by the solid lines. The stopping means 124 in the paper re-sending means 120 is held at the non-operating position shown by the two-dot chain line, and by the action of the delivery roller 126 rotating in the direction of arrow 144, the copying paper is delivered from the paper re-sending means 120 to the paper re-feeding passage 128. The copying paper sheets delivered to the paper re-feeding passage 128 are caused to advance one by one through the paper re-feeding passage 128 and again fed to the copying paper conveying passage 58. As can be easily understood from FIG. 1, the copying paper is reversed as a result of passing through the nearly semicircular paper re-feeding passage 128 and fed to the paper conveying passage 58 with its image-bearing surface down. It is then conveyed through the paper conveying passage 58. At this time, a toner image is transferred to the other surface of the copying paper (i.e., the upper surface) in the transferring zone 18, and fixed to the copying paper by the action of the pair of heat-fixing rollers 88. As a result, an image is formed on the other surface of the copying paper. Thereafter, the copying paper is introduced from the paper conveying passage 58 into the paper discharging passage 104 through the paper moving passage 96 in the conveyance controlling means 94, and discharged onto the receiving tray 106 through the paper discharge passage 104. Thus, a copy having an image formed on both surfaces is obtained.

The structure and operation described above of the illustrated electrostatic copying apparatus do not constitute novel features improved in accordance with the present invention, but merely illustrate one example of electrostatic copying apparatus to which the present invention is applicable. Hence, a detailed description of these will be omitted in the present specification.

Structure of the supporting frame

Figure 2:
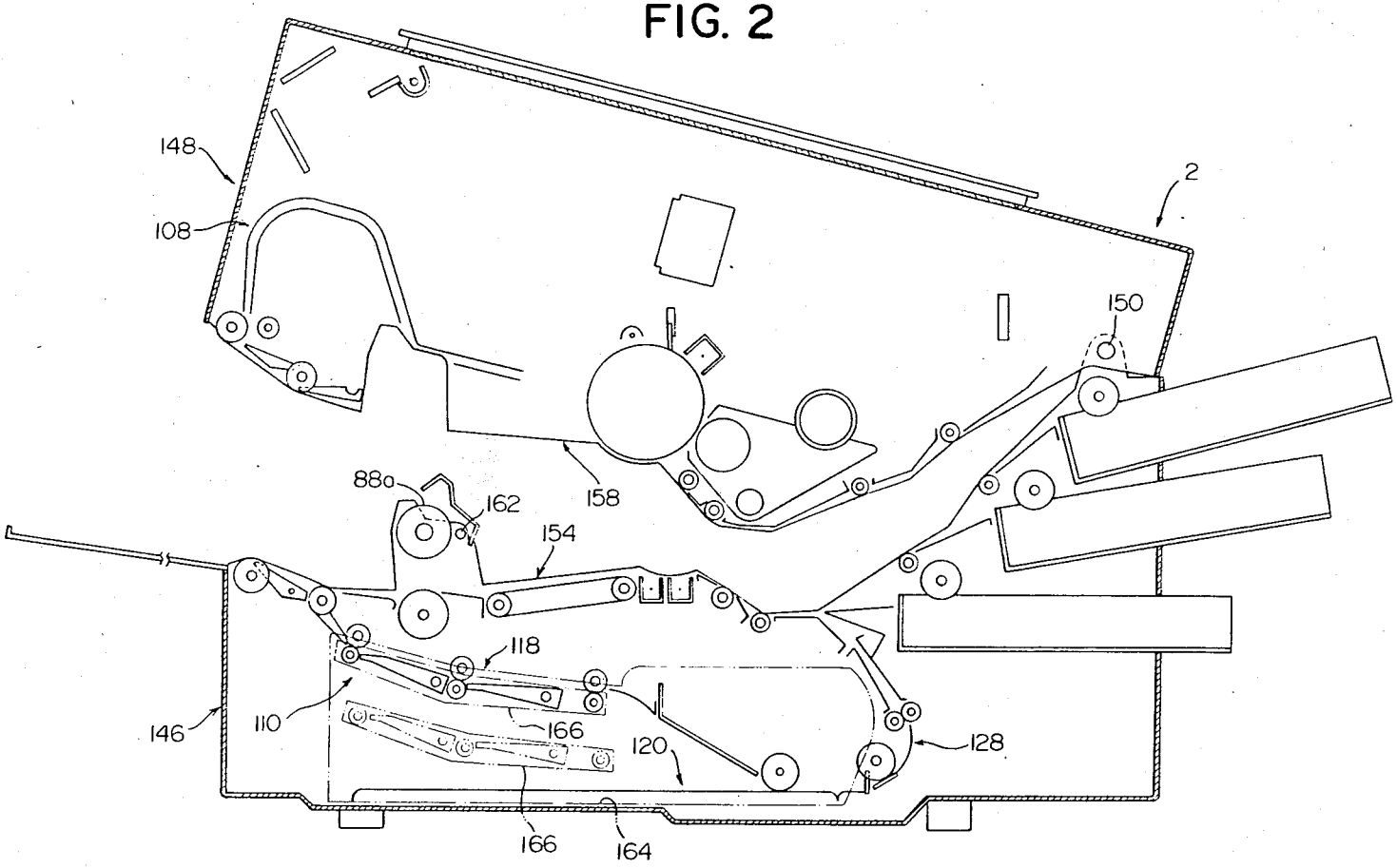
FIG. 2 is a sectional view, similar to FIG. 1, showing an upper supporting frame in the electrostatic copying apparatus of FIG. 1 as it is held at a non-operating position.

With reference to FIGS. 1 and 2, the housing 2 is comprised of a lower supporting frame 146 and an upper supporting frame 148. The upper supporting frame 148 is pivotably mounted on the lower supporting frame 146 via a supporting shaft 150, and pivots between an operating position (closed position) shown in FIG. 1 and a non-operating position (open position) shown in FIG. 2. The method of mounting the upper supporting frame 148 on the lower supporting frame 146 may be that disclosed, for example, in Japanese Laid-Open Patent Publication No. 100459/1984, 152458/1984 or 188670/1984.

Figure 3:
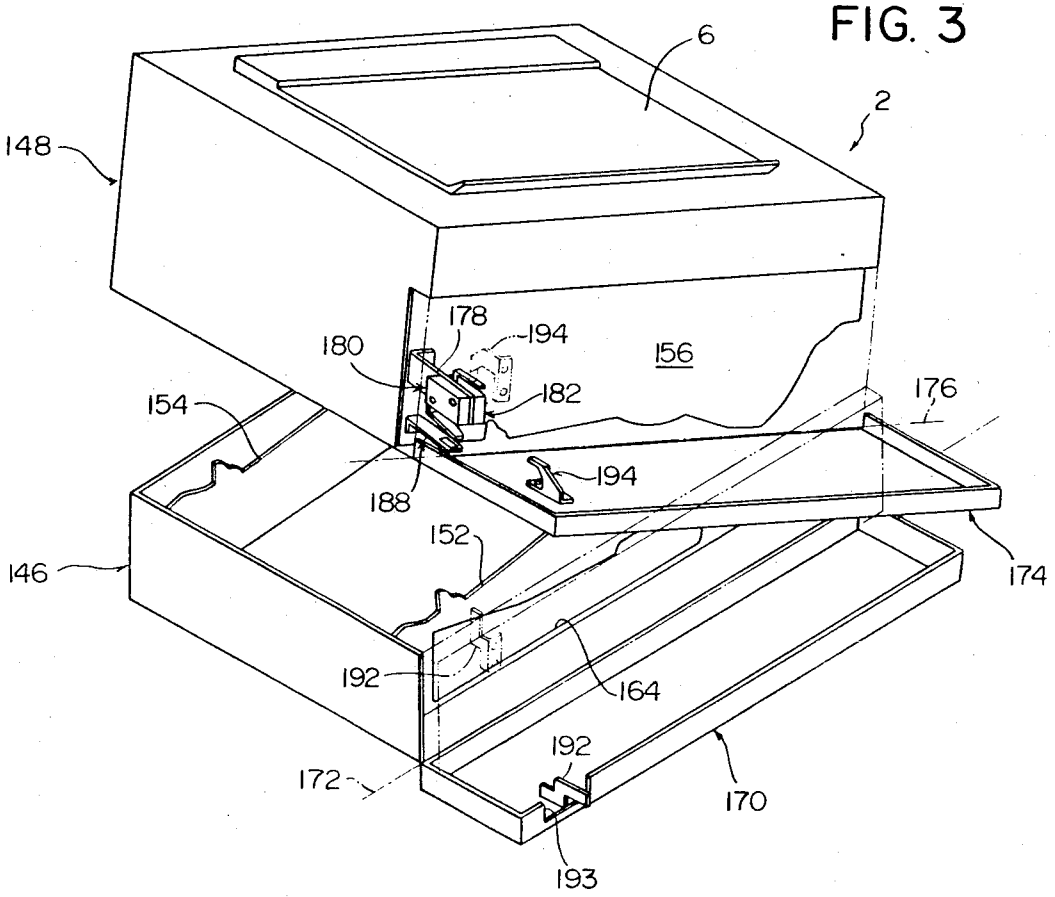
FIG. 3 is a simplified perspective view showing a supporting frame structure in the electrostatic copying apparatus in FIG. 1 as its upper supporting frame is held at the non-operating position.

With reference to FIG. 3, the lower supporting frame 146 is nearly in the shape of a box having an open top, and the upper supporting frame 148 is nearly in the shape of a box having an open bottom. The lower supporting frame 146 has a lower front base plate 152 and a lower rear base plate 154 disposed therein substantially vertically with a space therebetween in the forward-backward direction (a direction perpendicular to the sheet surface in FIGS. 1 and 2). Likewise, the upper supporting frame 148 has an upper front base plate 156 and an upper rear base plate 158 (FIGS. 1 and 2) disposed therein substantially vertically with a space therebetween in the forward-backward direction. Those of the various constituent elements described with reference to FIG. 1 which are disposed below a one-dot chain line 160 in FIG. 1 are mounted between the lower front base plate 152 and the lower rear base plate 154, and those constituent elements disposed above the one-dot chain line 160 in FIG. 1, between the upper front base plate 156 and the upper rear base plate 158. It will be understood therefore by reference to FIGS. 1 and 2 that in the illustrated embodiment, when the entire paper feeding passages 56*a*, 56*b* and 56*c*, a greater part of the paper conveying passage 58 (more specifically that portion of the passage 58 excluding the portion defined by the pair of heat-fixing rollers 88), and the paper discharge passage 104 are defined between the lower supporting frame 146 and the upper supporting frame 148 when the upper supporting frame 148 is held at the operating position shown in FIG. 1, and are set free when the upper supporting frame 148 is held at the non-operating position shown in FIG. 2. In the illustrated embodiment, an upper roller 88*a* of the pair of heat-fixing rollers 88 and means for supporting it are mounted for free pivotal movement between an operating position (closed position) shown in FIG. 1 and a non-operating position shown in FIG. 2 about a supporting shaft 162 as a center. Accordingly, when the upper supporting frame 148 is held at the non-operating position shown in FIG. 2 and then the upper roller 88*a* and the supporting means therefor are held at the non-operating position shown in FIG. 2, the paper conveying passage 58 is opened entirely. The paper reversing passage 108 is provided within the upper supporting frame 148, more specifically between the upper front base plate 156 and the upper rear base plate 158, and the paper returning passage 110, the paper re-sending means 120 and the paper re-feeding passage 128 are provided inside the lower supporting frame 146, more specifically between the lower front base plate 152 and the lower rear base plate 154.

Figure 4:
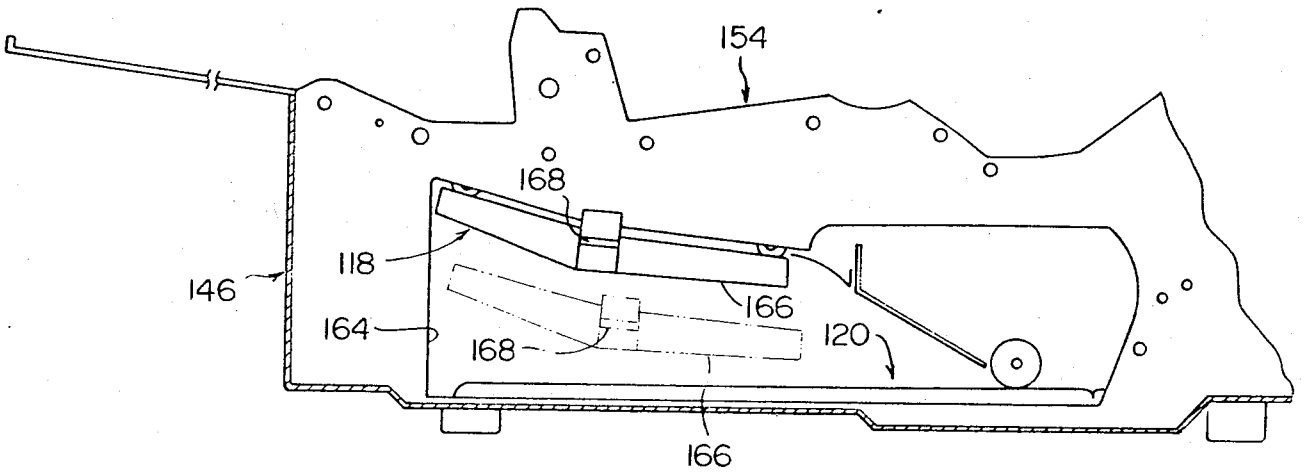
FIG. 4 is a partial front view showing a part of a lower front base plate of a lower supporting frame in the electrostatic copying apparatus of FIG. 1.

With reference to FIGS. 1 and 2 taken in conjunction with FIG. 4, a relatively large single continuous opening 164 is formed in the lower front base plate 152 of the lower supporting frame 148. The opening 164 continuously extends along a greater part of the paper returning passage 110, more specifically, over an area where a portion defined by the returning mechanism 118 exists, and an area where nearly entire copying paper re-sending means 120 exists. The right edge of the opening 164 in FIGS. 1 and 4 adjoins the paper re-feeding passage 128. Hence, when paper jamming occurs in the paper returning passage 110, paper re-sending means 120 and paper re-feeding passage 128, the paper which has jammed up can be easily removed by hand through the opening 164. The returning mechanism 118 in the paper returning passage 110 has a movable frame 166. The movable frame 166 is mounted on the lower rear base plate 154 (FIG. 3) such that it can pivot between an operating position shown by a solid line in FIG. 4 and a non-operating position shown by a two-dot chain line in FIG. 4 about a pivot axis extending along its rear edge as a center. As is clearly seen from FIG. 4, the opening 164 extends not only in an area where the movable frame 166 exists when held at the operating position but also in an area where the movable frame 166 exists when held at the non-operating position. The upper elements in the returning mechanism 118 (i.e., the elements defining the upper portion of the paper returning passage 110) are directly mounted on the lower front base plate 152 and the lower rear base plate 154 of the lower supporting frame 146, but the lower elements of the returning mechanism 118 (i.e., the elements defining the lower portion of the copying paper returning passage 110) are mounted on the movable frame 166. Hence, when paper jamming occurs in the returning mechanism 118, the operator can easily get access to the copying paper that has jammed up by holding a gripping portion 168 formed at the front end of the movable frame 166 and moving the movable frame 166 from the operating position shown by the solid line to the non-operating position shown by the two-dot chain line thereby to open the paper returning passage 110 in the returning mechanism 118. Thus, he can easily remove that paper from the returning passage.

With reference to FIG. 3, the front wall of the lower supporting frame 146 is defined by a lower front cover member 170 that can be freely opened and closed. The lower front cover member 170 is mounted by a suitable mounting mechanism (not shown) so that it can pivot freely between a closed position (the position shown by a two-dot chain line in FIG. 3) at which it covers nearly the entire front surface of the lower supporting frame 146 and an open position (the position shown by a solid line in FIG. 3) at which the nearly entire front surface of the lower supporting frame 146 is exposed to view about a pivot axis 172 extending along its lower edge as a center. Likewise, that part of the front wall of the upper supporting frame 148 which is other than the upper end portion is defined by an upper front cover member 174 that can be freely opened and closed. The upper front cover member 174 is mounted on a suitable mounting mechanism (not shown) so that it can freely pivot between a closed position (the position shown by a two-dot chain line in FIG. 3) at which it covers the front surface of the upper supporting frame 148 excepting the upper end portion and an open position (the position shown by a solid line in FIG. 3) at which the front surface of the upper supporting frame 148 excepting the upper end portion is exposed to view about a pivot axis 176 extending along its lower edge.

Locking means and detecting means

Figure 5:
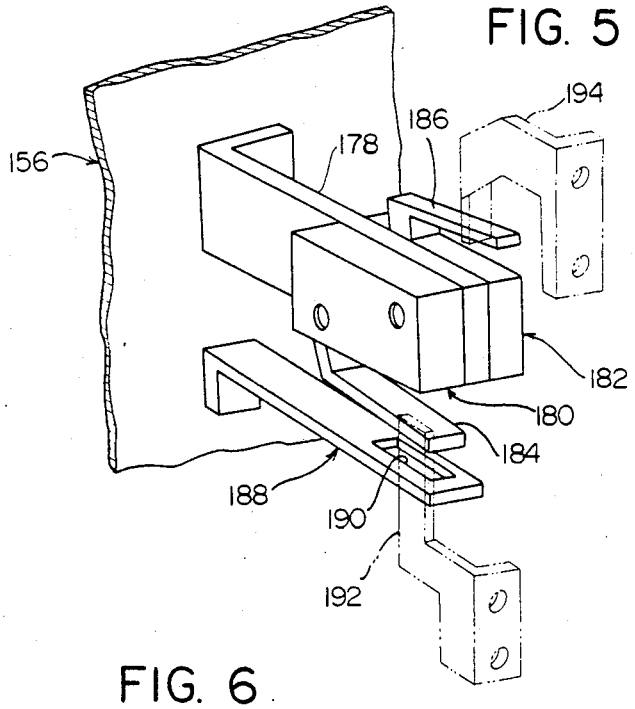
FIG. 5 is a partial perspective view showing a locking means and a detecting means in the electrostatic copying apparatus of FIG. 1.

With reference to FIG. 5 as well as FIG. 3, a supporting plate 178 extending forwardly from the upper front base plate 156 in the upper supporting frame 148 is fixed to the upper front base plate 156. A first detecting element 180 is fixed to one surface of the supporting plate 178, and a second detecting element 182, to the other surface. The first detecting element 180 may be a limit switch having a detecting arm 184, and likewise, the second detecting element 182 may be a limit switch having a detecting arm 186. To the upper front base plate 156 in the upper supporting frame 148 is further fixed a restraining member 188 composed of a plate-like member extending forwardly from the upper front base plate 156 below the supporting plate 178. An opening 190 located beneath the forward end portion of the detecting arm 184 of the first detecting element 180 is formed in the forward end portion of the restraining member 188.

A piece 192 is fixed to the back surface of the lower front cover member 170 in the lower supporting frame 146. As is clearly shown in FIG. 3, the free end of the piece 192 projects beyond the upper end of the lower front cover member 170 via a cut 193 formed in the upper wall portion of the lower front cover member 170. The piece 192 functions not only as a restrained member constituting a locking means in cooperation with the restraining member 188 but also as a detected element constituting a first detecting means in cooperation with the first detecting element 180. A piece 194, on the other hand, is fixed to the back surface of the upper front cover member 174 in the upper supporting frame 148. As will be clear from a description to be given hereinafter, the piece 194 functions as a detected element constituting a second detecting means in cooperation with the second detecting element 182.

It will be appreciated with reference to FIGS. 3 and 5 that when the lower front cover member 170 in the lower supporting frame 146 is held at the closed position shown by the two-dot chain line and then the upper supporting frame 148 is held at the operating position (FIG. 1), the front end portion of the piece 192 is received in the opening 190 of the restraining member 188. As a result, the forward movement of the piece 192 is restrained by the restraining member 188, and therefore, the lower front cover member 170 is locked at the closed position shown by the two-dot chain line in FIG. 3. In other words, in the illustrated electrostatic copying apparatus, when the upper supporting frame 148 is at the operating position (FIG. 1), the lower front cover member 170 is locked at the closed portion by the cooperative action of the restraining member 188 and the piece 192, and the lower front cover member 170 cannot be moved to the opened position shown by the solid line in FIG. 3. When the upper supporting frame 148 is held at the non-operating position shown in FIG. 3, the restraining member 188 is disengaged from the piece 192 and the lower front cover member 170 can be moved to the opened position shown by the solid line in FIG. 3.

When the lower front cover member 170 in the lower supporting frame 146 is held at the closed position shown by the two-dot chain line in FIG. 3 and then the upper supporting frame 148 is held at the operating position (FIG. 1), the forward end portion of the piece 192 is received in the opening 190 of the restraining member 188 and the lower front cover member 170 is locked at the closed position. In addition, as can be understood from FIG. 5, the forward end of the piece 192 presses the detecting arm 184 of the first detecting element 180 whereby the first detecting element 180 is turned on. When the upper front cover member 174 in the upper supporting frame 148 is held at the closed position shown by the two-dot chain line in FIG. 3, the forward end of the piece 194 presses the detecting arm 186 of the second detecting element 182 whereby the second detecting element 182 is turned on. The first detecting element 180 and the second detecting element 182 function as safety switches, and the electrostatic copying apparatus can be operated when both the first detecting element 180 and the second detecting element 182 are on.

If desired, the restrained member and the detected element may be constructed of separate pieces. It is also possible to fix the piece 192 to the upper front base plate 156 of the upper supporting frame 148 and the first detecting element 180 and the restraining member 188, to the lower front cover member 170 of the lower supporting frame 146. Furthermore, it is possible to fix the piece 194 to the upper front base plate 156 of the upper supporting frame 148 and the second detecting element 182, to the upper front cover member 174 of the upper supporting frame 148.

Procedure of dealing with paper jamming

With reference to FIGS. 1, 2 and 3, when paper jamming occurs in the paper feeding passage **56*a*, 56*b* or 56*c*, the paper conveying passage 58 or the paper discharging passage 104 during its operation in a mode of forming an image only on one surface of a copying paper and the operation of the copying apparatus is stopped, the operator first brings the upper supporting frame 148 to the non-operating position shown in FIGS. 2 and 3. As a result, the entire paper feeding passage 56*a*, 56*b* or 56*c*, a greater portion of the paper conveying passage 58 (excepting a portion defined by the pair of heat-fixing rollers 88) and the entire paper discharging passage 104 are open. As required, the operator keeps the upper roller 88*a* of the heat-fixing rollers 88 and the supporting means therefor at the non-operating position shown in FIG. 2 and thus opens the entire paper conveying passage 58. The operator can then get access to the copying paper and remove it from the paper feeding passage 56*a*, 56*b* or 56*c*, the paper conveying passage 58 or the paper discharging passage 104**.

Now, let us assume that paper jamming occurs during the operation of the electrostatic copying apparatus in a mode of forming an image on both surfaces of a copying paper, and the operation of the electrostatic copying apparatus is stopped. In this case, the following fact should be noted. In the case of obtaining a plurality of copies from the same document, when paper jamming occurs in the paper returning passage 110 or the paper re-sending means 120, succesive copying paper sheets exist in the paper feeding passage **56*a*, 56*b* or 56*c*, the paper conveying passage 58 or the paper reversing passage 108 unless the paper that has jammed up is for the last copy to be obtained. Hence, these paper sheets should also be removed. In the illustrated electrostatic copying apparatus, it is first necessary to hold the upper supporting frame 148 at the non-operating position shown in FIGS. 2 and 3 prior to opening movement of the lower front cover member 170 in order to remove paper sheets existing in the paper returning passage 110, the paper re-sending means 120 or the paper re-feeding passage 128 disposed within the lower supporting frame 146. So long as the upper supporting frame 148 is kept at the operating position shown in FIG. 1, the opening movement of the lower front cover member 170 is hampered by the action of the locking means (the restraining member 188 and the piece 192) described above. Thereafter, as required, the upper roller 88*a* of the heat-fixing rollers 88 and the supporting member therefor are held at the non-operating position shown in FIG. 2, and then the paper sheets existing in the paper feeding passage 56*a*, 56*b* or 56*c*, the paper conveying passage 58 or the paper reversing passage 108 are removed. The copying paper existing in the paper reversing passage 108 can be easily removed by hand from the open bottom surface of the upper supporting frame 148. Thereafter, the lower front cover member 170 is held at the open position shown by the solid line in FIG. 3. Then, as required, the movable frame 166 of the returning mechanism 118 is held at the non-operating position shown by the two-dot chain line in FIG. 4. When the lower front cover member 170 is held at the open position, the opening 164 formed on the lower front base plate 152 is exposed to view. The copying paper existing in the paper returning passage 110, the paper re-sending means 120 or the paper re-feeding passage 128 can be easily removed by hand through the opening 164. When, for example, a copying paper is removed only from the paper returning passage 110 or the paper re-sending means 120 and a copying paper to be removed is carelessly left in the paper feeding passage 56***a*, 56*b* or 56*c*, the paper conveying passage 58 or the paper reversing passage 108, various inconveniences will occur upon resumption of the operation of the electrostatic copying apparatus. In the electrostatic copying apparatus shown in the drawings, the occurrence of such inconveniences can be fully and accurately prevented.

Conveyance controlling means

Figure 6:
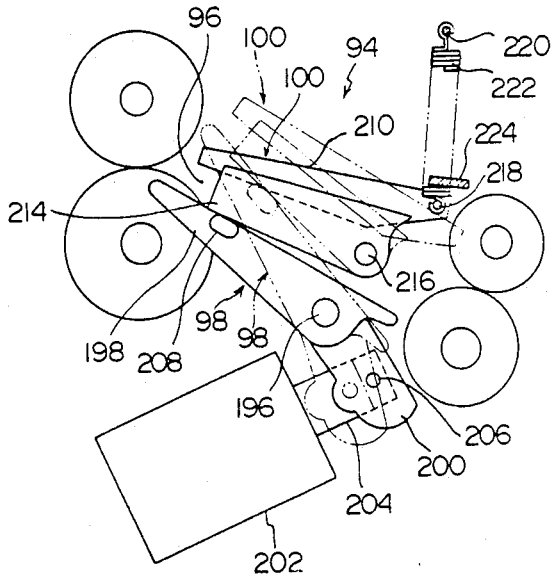
FIG. 6 is a partial sectional view showing a conveyance controlling means in the electrostatic copying apparatus of FIG. 1.
Figure 7:
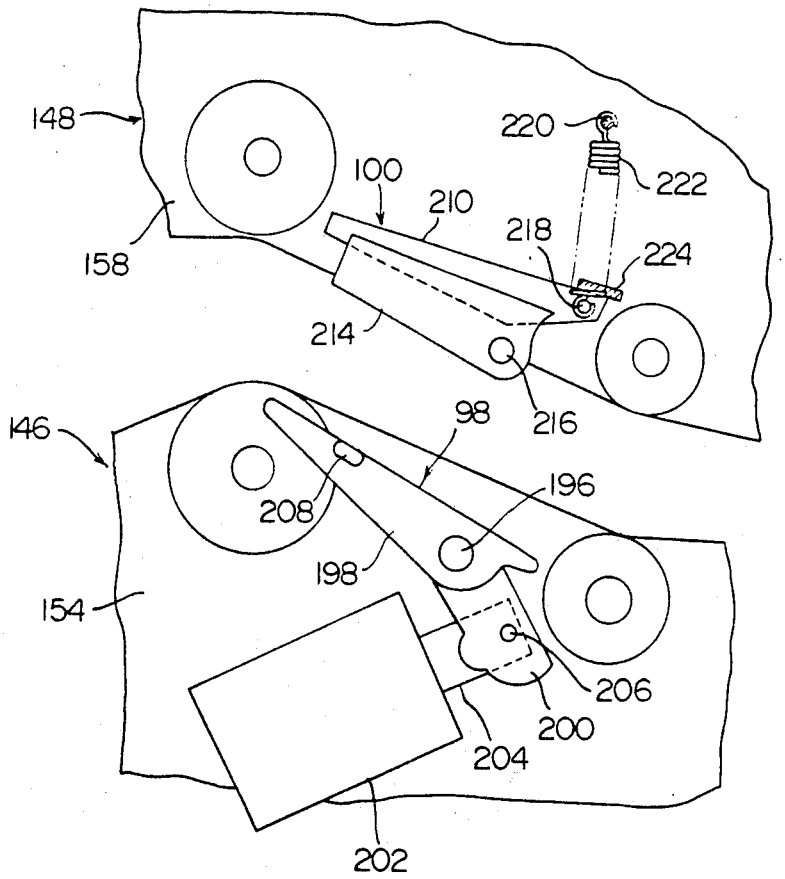
FIG. 7 is a partial sectional view, similar to FIG. 6, showing the conveyance controlling means in the electrostatic copying apparatus of FIG. 1 as the upper supporting frame has been moved to some extent toward the non-operating position from its operating position.
Figure 8:
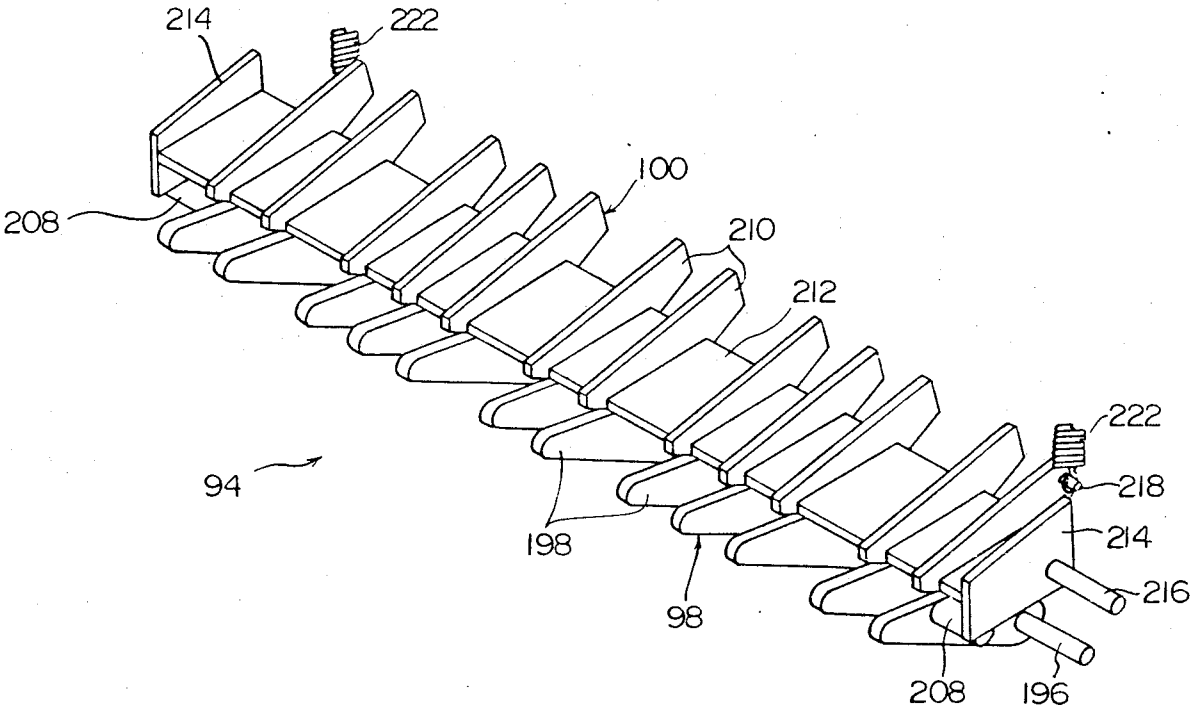
FIG. 8 is a partial perspective view showing the conveyance controlling means in the electrostatic copying apparatus of FIG. 1.

With reference to FIGS. 6 to 8, the structure of the conveyance controlling means 94 will be described in detail. As stated above, the conveyance controlling means 94 includes the lower movable guide member 98 and the upper movable guide member 100. As most clearly shown in FIG. 8, the lower movable guide member 98 has a supporting shaft 196, and a plurality of axially spaced lower guide pieces 198 of a nearly triangular shape are formed integrally with the supporting shaft 196. The opposite end portions of the supporting shaft 196 are pivotably mounted on the lower front base plate 152 and the lower rear base plate 154 in the lower supporting frame 146. Consequently, the lower movable guide member 98 is pivotably mounted at a predetermined position of the lower supporting frame 146 (see FIG. 3, also). A linking piece 200 (FIGS. 6 and 7) is also formed integrally with the supporting shaft 196. An actuating means which may be an electromagnetic solenoid 202 is connected to the linking piece 200. More specifically, the main body of the electromagnetic solenoid 202 is fixed to a predetermined position of the lower supporting frame 146 (FIG. 7), and its iron core 204 is connected pivotably to the linking piece 200 by means of a linking pin 206. When the electromagnetic solenoid 202 is deenergized, the lower movable guide member 98 is held at the position shown by the solid line in FIG. 6, i.e. at the lowered position. When the electromagnetic solenoid 202 is energized, the lower movable guide member 98 is pivoted to the position shown by a two-dot chain line in FIG. 6, i.e. the elevated position. The lower movable guide member 98 has also formed integrally therewith projections 208 extending outwardly from the outside surfaces of those lower guide pieces 198 which are located outermost on both sides. Such projections 208 constitute an abutting means acting on the upper movable guide member 100 as will be apparent from a statement given hereinafter.

The upper movable guide member 100 has an elongate plate-like member 212 having formed integrally therewith a plurality of longitudinally spaced upper guide pieces 210 of a nearly triangular shape. The upper guide pieces 210 are located such that they correspond respectively to the lower guide pieces 198 in the lower movable guide member 98. Nearly rectangular pieces 214 are formed integrally on both ends of the plate-like member 212, and outwardly extending short shafts 216 are formed integrally on the outside surfaces of the pieces 214. The pieces 214 constitute an abutment means which cooperates with the projections in the lower movable guide member 98, i.e. the abutting means 208. The short shafts 216 are respectively mounted pivotably on the upper front base plate 156 (FIG. 3) and the upper rear base plate 158 (FIG. 7) in the upper supporting frame 148. Pins 218 are formed integrally on the outside surfaces of the rear end portions of those upper guide pieces 210 which are located outermost on both sides in the upper movable guide member 100. Pins 220 are correspondingly formed also on the inner surfaces of the upper front base plate 156 (FIG. 3) and the upper rear base plate 158 in the upper supporting frame 148. An elastic means which may be a tension spring 222 is disposed between each pin 218 and each pin 220. The tension spring 222 elastically biases the upper movable guide member 100 counterclockwise in FIG. 6. If desired, the upper movable guide member 100 can be biased counterclockwise in FIG. 6 by the own weight of the upper movable guide member 100. Furthermore, in the illustrated embodiment, a restriction means 224 constructed of a plate-like member is fixed to a predetermined position of the upper supporting frame 148.

When in the conveyance controlling means 94 described above, the upper supporting frame 148 is held at the operating position shown in FIG. 1 and the electromagnetic solenoid is in the deenergized state, the lower movable guide member 98 is held at the lowered position shown by the solid line in FIG. 6. The upper movable guide member 100 elastically biased counterclockwise in FIG. 6 by the tension spring 222 is held at the lowered position shown by the solid line in FIG. 6 as a result of its abutment means 214 being brought into abutment against the abutting means 208 of the lower movable guide member 98. With reference to FIGS. 1 and 6, when the lower movable guide member 98 and the upper movable guide member 100 are held at the lowered positions shown by the solid lines, the paper moving passage 96 defined between the upper edge of the lower guide member 198 in the lower movable guide member 98 and the lower edge of the upper guide member 210 in the upper movable guide member 100 permits communication between the paper conveying passage 58 and the paper discharging passage 104.

On the other hand, when the electromagnetic solenoid 202 is energized, the lower movable guide member 98 is pivoted clockwise in FIG. 6 and held at the elevated position shown by the two-dot chain line in FIG. 6. As a result, the upper movable guide member 100 is also pivoted clockwise in FIG. 6 against the elastic biasing action of the tension spring 222 by means of the abutting means 208 in the lower movable guide member 98 and the abutment means 214 in the upper movable guide member 100, and held at the elevated position shown by the two-dot chain line in FIG. 6. With reference to FIG. 1 as well as FIG. 6, when the lower movable guide member 98 and the upper movable guide member 100 are held at the elevated positions shown by the two-dot chain line, the paper moving passage 96 defined between the upper edge of the lower guide piece 198 in the lower movable guide member 98 and the lower edge of the upper guide piece 210 in the upper movable guide member 100 permits communication between the paper conveying passage 58 and the paper reversing passage 108 and between the paper reversing passage 108 and the paper returning passage 110.

The lower movable guide member 98 is mounted on the lower supporting frame 146 (FIG. 7), whereas the upper movable guide member 100, on the upper supporting frame 148 (FIG. 7). Accordingly, as shown in FIG. 7, when the upper supporting frame 148 is moved from the operating position shown in FIG. 1 toward the non-operating position shown in FIGS. 2 and 3, the upper movable guide member 100 moves upwardly away from the lower movable guide member 98 and the paper moving passage 96 (FIG. 6) defined between them is open. When the upper movable guide member 100 is moved upwardly away from the lower movable guide member 98, the abutment means 214 in the upper movable guide member 100 is disengaged from the abutment means 208 in the lower movable guide member 98. Hence, by the elastic biasing action of the tension spring 222, the upper movable guide member 100 tends to be pivoted counterclockwise in FIG. 7. When, however, the upper movable guide member 100 is pivoted slightly in the counterclockwise direction, the upper edge of the rear end portion of at least one of the upper guide pieces 210 in the upper movable guide member 100 abuts against the restriction means 224 fixed to the upper supporting frame 148 to hamper further counterclockwise pivoting of the upper movable guide member 100 in FIG. 7.

If desired, there may be an alternative embodiment in which in a state where the upper supporting frame 148 is held at the operating position and the electromagnetic solenoid 202 is in the deenergized state, the upper edge of the rear end portion of the upper guide piece 210 in the upper movable guide member 100 abuts against the restriction means 224 thereby to hold the upper movable guide member 100 at the lowered position shown by the solid line in FIG. 6, and at this time, there is some space between the abutting means 208 in the lower movable guide member 98 and the abutment means 214 in the upper movable guide member 100. In still another embodiment, the upper movable guide member 100 is held at the lowered position by the action of the abutting means and the abutment means when the upper movable guide member 100 is biased to the elevated position and the lower movable guide member 98 is held at the lowered position. Alternatively, contrary to the illustrated embodiment, it is possible to annex an actuating means such as an electromagnetic solenoid to the upper movable guide member 100 so that when the upper movable guide member 100 is moved to the lowered position (or the elevated position) from the elevated position (or the lowered position), the lower movable guide member 98 biased to the elevated position (or the lowered position) is brought to the lowered position (or the elevated position) by the action of the abutting means and the abutment means.

In the illustrated conveyance controlling means 94, the abutting means 208 and the abutment means 214 are provided respectively in the lower movable guide member 98 and the upper movable guide member 100 in order to enable both the lower movable guide member 98 and the upper movable guide member 100 to be positioned by a single actuating means (the electromagnetic solenoid 202). If desired, it is possible to connect the lower movable guide member 98 and the upper movable guide member 100 intergrally at their both side portions thereby enabling both the lower movable guide member 98 and the upper movable guide member 100 to be positioned by the single actuating means (electromagnetic solenoid 202). However, if such a structure is taken, the upper movable guide member 100 cannot be mounted on the upper supporting frame 148, and it is necessary to mount both the lower movable guide member 98 and the upper movable guide member 100 connected integrally to each other on the lower supporting frame 146. Alternatively, it is necessary to mount both the lower and upper movable guide members 98 and 100 connected integrally to each other on the upper supporting frame 148. Consequently, even when the upper supporting frame 148 is moved to the non-operating position shown in FIGS. 2 and 3, the paper moving passage 96 defined between the lower movable guide member 98 and the upper movable guide member 100 is not open, and therefore, in the case of dealing with paper jamming, it is somewhat troublesome to remove a copying paper existing at least partly in the paper moving passage 96.

First multifunctional conveying means

Figure 9:
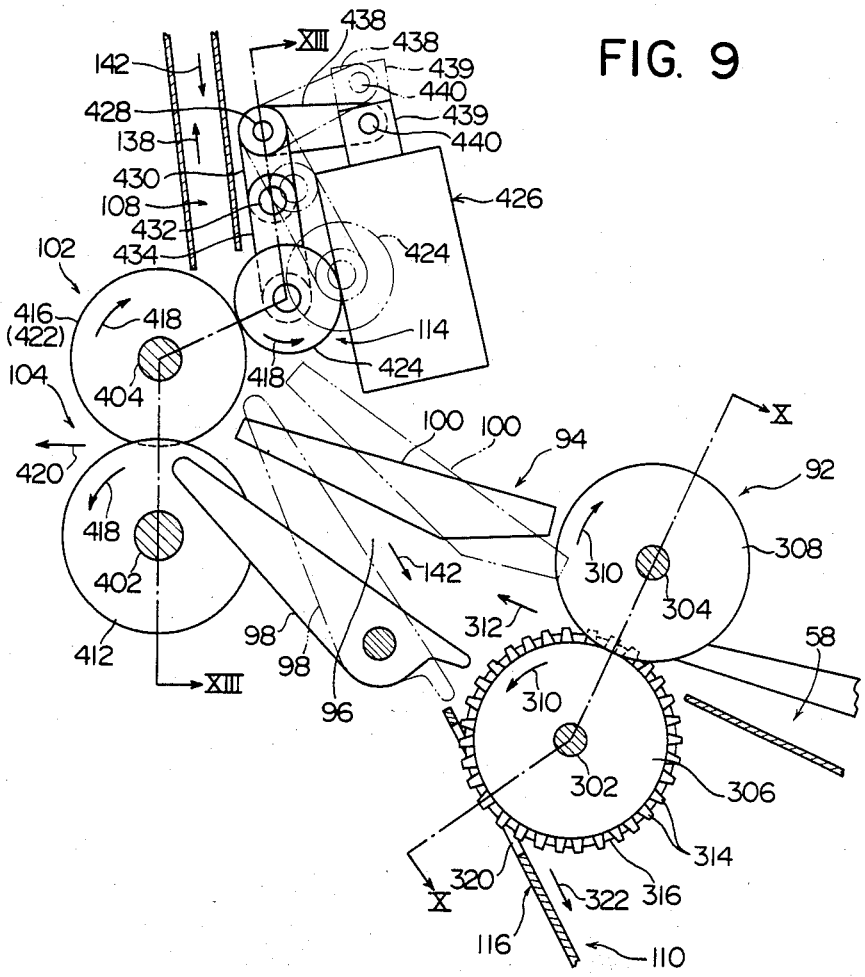
FIG. 9 is a partial sectional view showing a first multifunctional conveying means and a second multifunctional conveying means in the electrostatic copying apparatus of FIG. 1.
Figure 10:
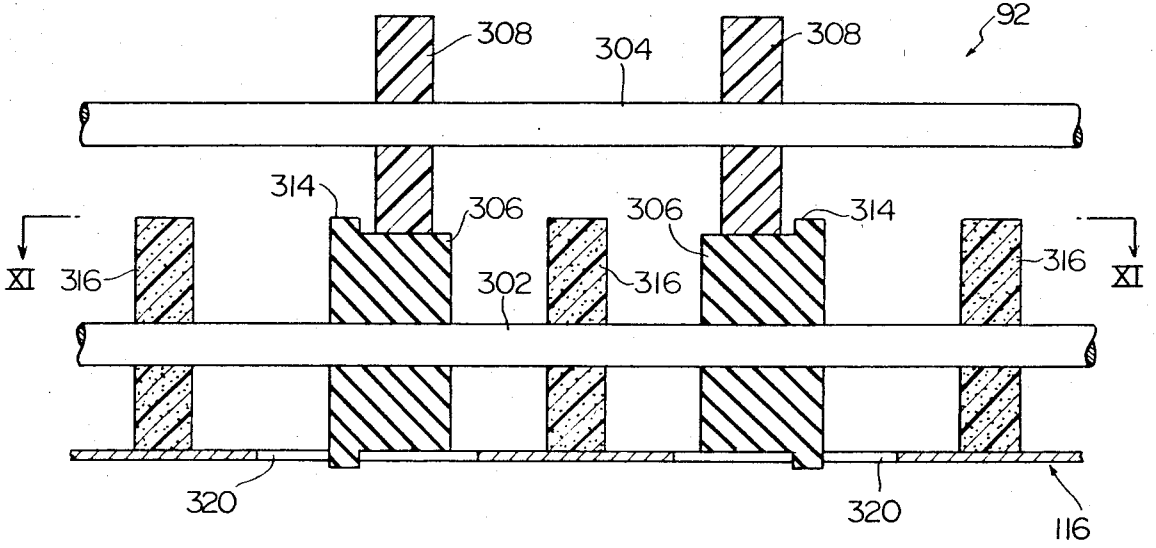
FIG. 10 is a partial sectional view taken along line X—X of FIG. 9.
Figure 11:
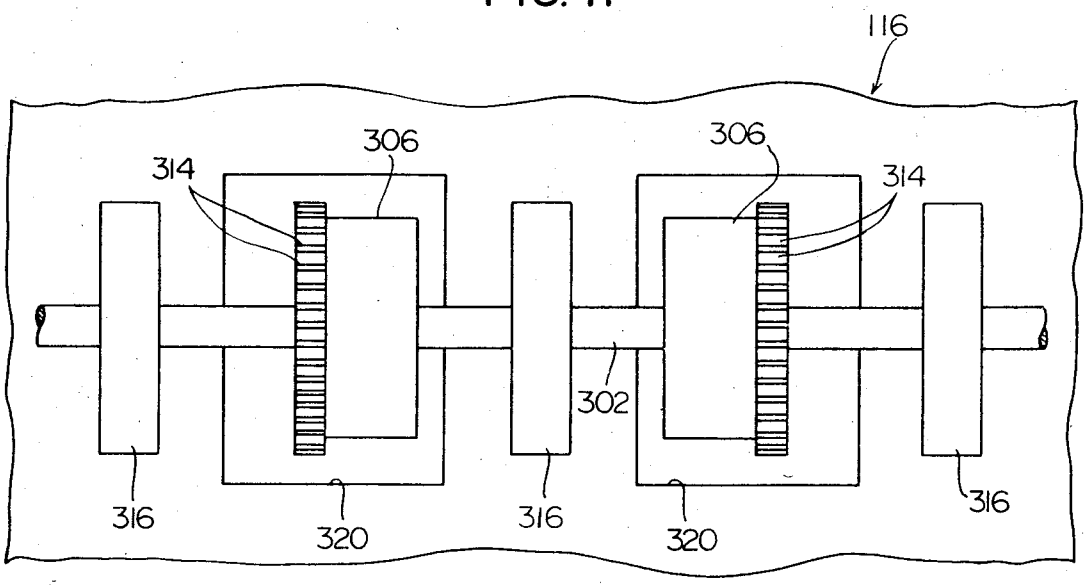
FIG. 11 is a partial top plan view seen from line XI—XI of FIG. 10.

With reference to FIGS. 9 to 11, the first multifunctional conveying means 92 will be described in detail.

The illustrated first multifunctional conveying means 92 includes a lower supporting shaft 302 and an upper supporting shaft 304 vertically spaced from each other. The lower supporting shaft 302 is rotatably mounted across the lower front base plate 152 and the lower rear base plate 154 of the lower supporting frame 146 (see FIGS. 1 to 3). The upper supporting shaft 304 is mounted rotatably across the upper front base plate 156 and the upper rear base plate 158 of the upper supporting frame 148 (see FIGS. 1 to 3). Two axially spaced first conveying rollers 306 are fixed to the lower supporting shaft 302, and two axially spaced second conveying rollers 308 corresponding to the two first conveying rollers 306 are fixed to the upper supporting shaft 304. Conveniently, the first conveying rollers 306 are made of a material having a relatively high coefficient of friction, such as synthetic rubber, and the second conveying rollers 308 are made of a material having a relatively low coefficient of friction, for example an ordinary synthetic resin such as polyacetal. The first conveying rollers 306 and the second conveying rollers 308 cooperating with each other constitute the pair of rollers 93 (FIG. 1) defining the downstream end of the paper conveying passage 58. The lower supporting shaft 302 is connected to a driving source (not shown) which may be an electric motor, and is rotated in the direction shown by an arrow 310 (FIG. 9). Thus, the first conveying rollers 306 and the second conveying rollers 308 are rotated in the direction of arrow 310, and by the cooperative action of the first conveying rollers 306 and the second conveying rollers 308, the copying paper is discharged from the downstream end of the paper conveying passage 58 in the direction shown by an arrow 312.

In the illustrated embodiment, as clearly shown in FIGS. 10 and 11, each of the first conveying rollers 306 has a larger width than each of the second conveying rollers 308, and both end portions of each of the first conveying rollers 306 project beyond both end portions of each of the second conveying rollers 308. A plurality of circumferentially spaced protrusions 314 are formed on one end portion, more specifically the axially outward end portion, of each of the first conveying rollers 306. The protrusions 314 which may be in the shape of a radially projecting trapezoid constitute a forcing means for forcing the trailing portion of the copying paper when the trailing end of the copying paper sheet discharged from the paper conveying passage 58 has passed the nipping site between the first conveying rollers 306 and the second conveying rollers 308 (the operation of the forcing means will be described in detail hereinafter).

In the illustrated first multifunctional conveying means 92, three axially spaced third conveying rollers 316 are further fixed to the lower supporting shaft 302. As clearly shown in FIGS. 10 and 11, the first conveying rollers 306 and the third conveying rollers 316 are alternately fixed to the lower supporting shaft 302. In addition, the stationary guide plate 116 cooperating with the third conveying rollers 316 are provided below the lower supporting shaft 302. The guide plate 116 in the widthwise direction extends over a region where the first conveying rollers 306 and the third conveying rollers 316 exist, and has openings 320 formed at parts opposite to the first conveying rollers 306. Hence, the first conveying rollers 306 are kept from contact with the guide plate 116. It is necessary on the other hand that the third conveying rollers 316 should be in contact with or close to the upper surface of the guide plate 116 so as to be able to cooperate with it. In the illustrated embodiment, the third conveying rollers are formed of a material having a relatively high coefficient of friction as in a foamed synthetic resin or a foamed synthetic rubber and being relatively flexible (such as a polyurethane foam), and each has a slightly larger outside diameter than each of the first conveying rollers 306. The third conveying rollers 316 are pressed by the upper surface of the guide plate 116 and slightly elastically deformed thereby. The third conveying rollers 316 and the guide plate 116 which cooperate with each other define the upstream end of the paper returning passage 110. When the copying paper which has been reversed in the moving direction as stated above is introduced between the third conveying rollers 316 and the guide plate 116, it is conveyed in the direction shown by an arrow 322 and carried into the paper returning passage 110 by the conveying action of the third conveying rollers 316 rotating in the direction of arrow 310.

The operation of the first multifunctional conveying means 92 described above will be described briefly below. When the copying paper conveyed through the conveying passage 58 reaches the downstream end of the conveying passage 58, the first conveying rollers 306 and the second conveying rollers 308 nip the copying paper and convey it in the direction of arrow 312. As a result, the copying paper is delivered to the paper moving passage 96 in the conveyance controlling means 94 from the paper conveying passage 58. When the conveyance controlling means 94 is at the lowered position shown by a solid line in FIG. 9, the copying paper is introduced into the paper discharging passage 104. When the conveyance controlling means 94 is at the elevated position shown by the two-dot chain line in FIG. 9, the copying paper is introduced into the paper reversing passage 108. It will be easily understood from FIG. 10 that when the copying paper is conveyed by the cooperative action of the first conveying rollers 306 and the second conveying rollers 308, the copying paper is bent somewhat in a wavy form in its widthwise direction (the left-right direction in FIG. 9) because the third conveying rollers 316 have a slightly larger outside diameter than the first conveying rollers 306 and the plurality of protrusions 314 are formed on one end portion of each first conveying roller 306. This increases the stiffness of the copying paper in its conveying direction. Thus, even when the copying paper intrinsically has a relatively low stiffness, it can be conveyed sufficiently accurately in the desired manner through the paper moving passage 96 in the conveyance controlling means 94.

When the trailing edge of the copying paper passed the nipping position between the first conveying rollers 306 and the second conveying rollers 308, the protrusions 314 formed in the first conveying rollers 306 forcibly move the trailing end portion of the copying paper downwardly. In more detail, since the protrusions 314 project radially from the first conveying rollers 306, the moving speed of the forward end portions of the protrusions 314 in the direction of arrow 310 is slightly larger than the peripheral speed of the first conveying rollers 306 (and therefore, the moving speed of the copying paper). Accordingly, when the trailing end of the copying paper has passed the nipping site between the first conveying rollers 306 and the second conveying rollers 308, one of the plurality of protrusions 314 formed in each of the first conveying rollers 306 abuts against the trailing end of the copying paper to bias the trailing end of the copying paper in the direction of arrow 314 (i.e. downwardly) forcibly, and thus forcibly move the trailing end of the copying paper downwardly.

The above action of the protrusions 314 is especially useful when the conveyance controlling means 94 is held at the elevated position shown by the two-dot chain line in FIG. 9. When the conveyance controlling means 94 is held at the elevated position shown by the two-dot chain line in FIG. 9, the copying paper is conveyed from the paper conveying passage 58 and carried into the paper reversing passage 108 via the paper moving passage in the conveyance controlling means 94. After some predetermined period of time from the time when the trailing end of the copying paper has passed the nipping site between the first conveying rollers 306 and the second conveying rollers 308, the moving direction of the copying paper is reversed by the action of the second multifunctional conveying means 102 (the second multifunctional conveying means 102 will be described in detail hereinafter). If at this time the trailing end of the copying paper exists near the nipping site between the first conveying rollers 306 and the second conveying rollers 308, the copying paper reversed in moving direction will inconveniently be led to the nipping position between the first conveying rollers 306 and the second conveying rollers 308 without being introduced into the upstream end of the paper returning passage 110, i.e. between the third conveying rollers 316 and the guide plate 116. In the illustrated embodiment, however, the copying paper whose trailing end portion has been forcibly moved downwardly by the action of the protrusions 314 and therefore which has been reversed in moving direction is moved along the upper surface of the guide plate 116 and accurately introduced between the third conveying rollers 316 and the guide plate 116. The copying paper so introduced is conveyed in the direction of arrow 322 by the cooperative action of the third conveying rollers 316 and the guide plate 116 and thus carried into the paper returning passage 110.

In the illustrated first multifunctional conveying means 92, the stationary guide plate 116 is used as means cooperating with the third conveying rollers 316. If desired, it is possible to provide rotatable rollers located below the third conveying rollers 316 and cooperating with the third conveying rollers 316 instead of the guide plate. This, however, makes the first multifunctional conveying means 92 complex, costly and large-sized. Furthermore, in the illustrated first multifunctional conveying means 92, the third conveying rollers 316 are fixed to the lower supporting shaft 302 independently of the first conveying rollers 306. If desired, the third conveying rollers 316 may be omitted, and the first conveying rollers 306 may be caused to cooperate with the second conveying rollers 308 and also with the guide plate 116 (or the rotatable roller in place of it).

In the illustrated first multifunctional conveying means 92, the protrusions 314 are provided at one end portion of each conveying roller 306. If desired, instead of this structure, it is possible to fix one or a plurality of forcing rollers having a plurality of spaced protrusions formed on the peripheral surface thereof to the lower supporting shaft 302 independently of the first conveying rollers 306.

Figure 12:
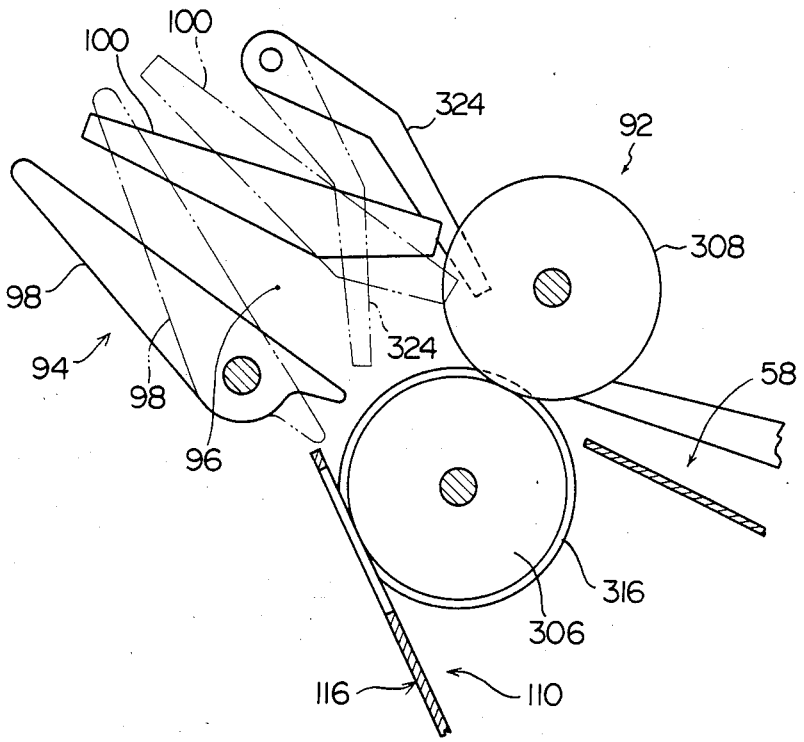
FIG. 12 is a partial sectional view showing a modified example of a forcing means in the first multifunctional conveying means.

FIG. 12 shows a modified example of forcing means which can be used instead of the protrusions 314 for forcibly moving the trailing end portion of the copying paper downwardly after the trailing end of the copying paper has passed the nipping site between the first conveying rollers 306 and the second conveying rollers 308. In the modified embodiment shown in FIG. 12, the forcing means is comprised of a movable member 324 disposed downstream of the nipping site between the first conveying rollers 306 and the second conveying rollers 308. The movable member 324 is pivotably mounted on a supporting shaft 326 and adapted to be selectively held at an upper non-operating position shown by a solid line and a lower operating position shown by a two-dot chain line by an actuating means (not shown) which may be an electromagnetic solenoid. When the actuating means is in the deenergized state, the movable member 324 is kept at the upper non-operating position shown by the solid line. At the upper non-operating position, the movable member 324 does not interfere with the copying paper passing through the paper moving passage 96 in the conveyance controlling means 94. On the other hand, the conveyance controlling means 94 is held at the elevated position shown by the two-dot chain line. Accordingly, when the copying paper is conveyed from the paper conveying passage 58 to the paper reversing passage 108 (FIGS. 1 and 9) via the paper moving passage 96 in the conveyance controlling means 94, the actuating means is energized after the trailing end of the copying paper has passed the nipping site between the first conveying rollers 306 and the second conveying rollers 308 and before or simultaneously with the reversing of the moving direction of the copying paper. As a result, the movable member 324 is held at the lower operating position shown by the two-dot chain line. Consequently, the free end portion of the movable member 324 projects into the paper moving passage 96 in the conveyance controlling means 94 to move the trailing end portion of the copying paper downwardly in a forcing manner. After the moving direction of the copying paper is reversed and the copying paper is introduced into the upstream end of the paper returning passage 110 (therefore, between the third conveying rollers 316 and the guide plate 116), the actuating means is deenergized and the movable member 324 is returned to the upper non-operating position shown by the solid line.

If desired, instead of annexing the actuating means exclusively used for the movable member 324, it is possible to connect the movable member 324 to the pressing means 114 (FIGS. 1 and 9) in the second multifunctional conveying means 102 so that the movable member 324 moves according to the movement of the pressing means 114. More specifically, in such an alternative structure, when the pressing means 114 is at the non-operating position shown by the solid line in FIG. 1 and the two-dot chain line in FIG. 9, the movable member 324 is also held at the upper non-operating position shown by the solid line in FIG. 12, and when the pressing means 114 is moved to the operating position shown by the two-dot chain line in FIG. 1 and the solid line in FIG. 9, the movable member 324 is also moved to the lower operating position shown by the two-dot chain line in FIG. 12. The second multifunctional conveying means 102 will be described in detail in the next section.

Second multifunctional conveying means

Figure 13:
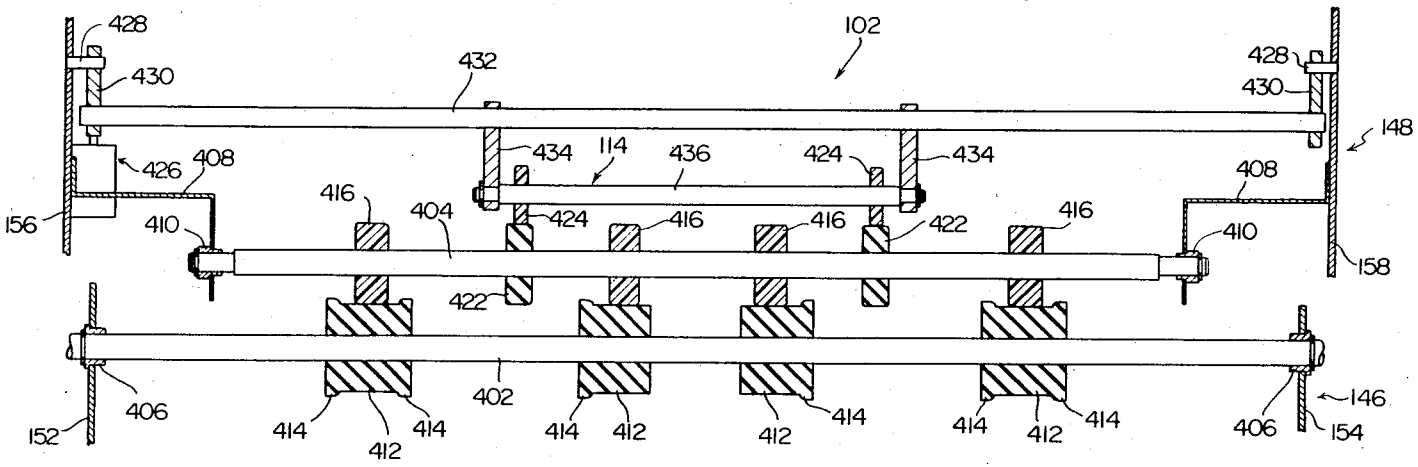
FIG. 13 is a partial sectional view taken along line XIII—XIII of FIG. 9.

With reference to FIGS. 9 and 13, the second multifunctional conveying means 102 will be described. The illustrated second multifunctional conveying means 102 includes a lower supporting shaft 402 and an upper supporting shaft 404 spaced from each other vertically. The lower supporting shaft 404 is rotatably mounted across the lower front base plate 152 and the lower rear base plate 154 of the lower supporting frame 146 by means of bearing members 406 (see FIGS. 1 to 3 also). A bracket 408 projecting in an L-shape is fixed to the inner surface of each of the upper front base plate 156 and the upper rear base plate 158 of the upper supporting frame 148 (see FIGS. 1 to 3 also). The upper supporting shaft 404 is rotatably mounted across the brackets 408 by means of bearing members 410. Four axially spaced first conveying rollers 412 are fixed to the lower supporting shaft 402. Conveniently, the first conveying rollers 412 are formed of a material having a relatively high coefficient of friction such as synthetic rubber. In the illustrated embodiment, an annular protrusion 414 extending continuously in the circumferential direction is formed in one end portion, the axially outward end portion, of each of centrally located two first conveying rollers 412 out of the four first conveying rollers 412, and similarly, an annular protrusion 414 extending continuously in the circumferential direction is formed in both end portions of each of the two outwardly located first conveying rollers 412. To the upper supporting shaft 404 are fixed four axially spaced second conveying rollers 416 corresponding to the four first conveying rollers 412. The second conveying rollers 416 are conveniently formed of a material having a relatively low coefficient of friction such as a suitable synthetic resin (e.g., polyacetal). The first conveying rollers 412 and the second conveying rollers 416 cooperating with each other constitute the pair of conveying rollers 103 (FIG. 1) defining the upstream end of the paper descharging passage 104. The lower supporting shaft 402 is connected to a driving source (not shown) which may be an electric motor, and rotated in the direction shown by an arrow 418 (FIG. 9). Thus, the first conveying rollers 412 and the second conveying roller 416 are rotated in the direction of arrow 418, and the copying paper introduced into the paper discharging passage 104 is conveyed in the direction shown by an arrow 420 by the cooperative action of the first conveying rollers 412 and the second conveying rollers 416.

Two axially spaced third conveying rollers 422 are fixed further to the upper supporting shaft 404. The third conveying rollers 422 have substantially the same outside diameter as the outside diameter of each second conveying roller 416. Conveniently, the third conveying rollers 422 are formed of a material having a relatively high coefficient of friction such as synthetic rubber.

The second multifunctional conveying means 102 further includes the pressing means 114 disposed in relation to the third conveying rollers 422. In the illustrated embodiment, the pressing means 114 is comprised of two rotatable rollers 424 corresponding to the two third conveying rollers 422. The rollers 424 are adapted to be selectively held at an operating position shown by a solid line in FIG. 9 (a two-dot chain line in FIG. 1) and a non-operating position shown by a two-dot chain line in FIG. 9 (a solid line in FIG. 1) by an actuating means which may be an electromagnetic solenoid 426. At the operating position, the rollers 424 are pressed by the third conveying rollers 422, and at the non-operating position, the rollers 424 are set apart from the third conveying rollers 422. In more detail with reference to FIG. 13 as well as FIG. 9, a pin member 428 is firmly set in the inner surface of each of the upper front base plate 156 and the upper rear base plate 158 of the upper supporting frame 148, and a lever member 430 is mounted pivotably on each such pin member 428. A lateral member 432 is fixed between the two lever members 430, and a pair of supporting members 434 spaced from each other are fixed to the lateral member 432. A shaft member 436 is rotatably mounted across the free end portions of the pair of supporting members 434, and the aforesaid two rollers 424 are fixed to the shaft member 436. One of the lever members 430, i.e. the lever member 430 located on the left in FIG. 13, has an additional portion 438 extending to the right in FIG. 9. The main body of the electromagnetic solenoid 426 is fixed to the upper front base plate 156, and the forward end portion of its movable iron core 439 is pivotably connected to the forward end portion of the additional portion 438 of the lever member 430 through a pin 440. As a result, when the electromagnetic solenoid 426 is deenergized, the rollers 424 are held at the non-operating position shown by the two-dot chain line in FIG. 2 at which they are set apart from the third conveying rollers 424. When the electromagnetic solenoid 426 is energized, the rollers 424 are held at the operating position shown by the solid line in FIG. 9 at which they are pressed by the third conveying rollers 422. Accordingly, the shaft member 436 and the rollers 424 fixed to it are rotated in the direction of arrow 418 incident to the rotation of the third conveying rollers 422. Preferably, the rollers 424 constituting the pressing means 114 are formed of a material having a relatively low coefficient of friction, such as a suitable synthetic resin (e.g., polyacetal).

The operation of the second multifunctional conveying means 102 will be described below briefly. When the conveyance controlling means 94 described hereinabove is at the lowered position shown by the solid line in FIG. 9, the copying paper conveyed from the paper conveying passage 58 through the paper moving passage 96 in the conveyance controlling means 94 is introduced into the paper discharging passage 104. The first conveying rollers 412 and the second conveying rollers 416 nip the copying paper and convey it in the direction shown by arrow 420. Since the first conveying rollers 412 are made of a material having a relatively high coefficient of friction, slippage between the first conveying rollers 412 and the copying paper is fully prevented, and the copying paper is conveyed fully accurately in the direction of arrow 420. In addition, since the annular protrusions 414 are formed in the first conveying rollers 412 as can be easily seen by reference to FIG. 13, the copying paper nipped by the first conveying rollers 412 and the second conveying rollers 416 is bent somewhat in a wavy form in its widthwise direction (the left-right direction in FIG. 9), and the stiffness of the paper in the conveying direction is increased. Accordingly, even when the copying paper has a relatively low stiffness, it can be conveyed fully accurately and discharged into the receiving tray 106 (FIG. 1).

When the conveyance controlling means 94 is at the elevated position shown by the two-dot chain line in FIG. 9, the copying paper conveyed from the paper conveying passage 58 through the paper moving passage 96 in the conveyance controlling means 94 is introduced into the paper reversing passage 108. At this time, the electromagnetic solenoid 426 is deenergized and the rollers 424 are held at the non-operating position shown by the two-dot chain line in FIG. 9. Hence, the copying paper introduced into the paper reversing passage 108 passes between the third conveying rollers 422 and the rollers 424 at the non-operating position and moves in the direction of arrow 138 through the paper reversing passage 108. Even when the copying paper makes contact with the second conveying rollers 416 and the third conveying rollers 422 rotating in the direction of arrow 418, the movement of the copying paper in the direction of arrow 138 is not hampered since this contact is without pressure. When the trailing end of the copying paper then passes the downstream end of the paper conveying passage (i.e. the nipping site between the first conveying rollers 306 and the second conveying rollers 308 in the first multifunctional conveying means 92), the electromagnetic solenoid 426 is energized after a lapse of some predetermined period of time from that time of passing. As a result, the rollers 424 are held at the operating position shown by the solid line in FIG. 9 and the copying paper is pressed against the third conveying rollers 422 by the rollers 424. The copying paper now undergoes the conveying action of the third conveying rollers 422 rotating in the direction of arrow 418, and its moving direction is reversed. The copying paper then begins to move in the direction of arrow 142, and the rollers 422 begin to rotate in the direction of arrow 418. Since the third conveying rollers 422 are formed of a material having a relatively high coefficient of friction, slippage between the copying paper and the third conveying rollers 422 is fully accurately prevented when the copying paper is pressed against the third conveying rollers 422 by the rollers 424. Thus, the copying paper is moved fully accurately in the direction of arrow 142. The copying paper moved in the direction of arrow 142 after reversing its moving direction is introduced into the paper returning passage 110 as stated hereinabove. The copying paper then begins to undergo the action of the third conveying rollers 316 and the guide plate 116 in the first multifunctional conveying means 92. After some predetermined period of time from then, the electromagnetic solenoid 426 is deenergized to return the rollers 424 to the non-operating position shown by two-dot chain line in FIG. 9.

In the illustrated second multifunctional conveying means 102, the third conveying rollers 422 are fixed to the upper supporting shaft 404 independently of the second conveying rollers 416 and the rollers 424 constituting the pressing means 114 and the third conveying rollers 422 are selectively pressed. If desired, the third conveying rollers 422 may be omitted, and the rollers 424 may be selectively pressed against the second conveying rollers 416. In this alternative construction, the second multifunctional conveying means 102 can be made simpler in structure and lower in cost, but the following inconvenience may arise. When the third conveying rollers 422 are omitted and the rollers 424 are selectively pressed against the second conveying rollers 416, it is desired to make the second conveying rollers 416 from a material having a relatively high coefficient of friction as in the first conveying rollers 412, so that the copying paper can be moved accurately in the direction of arrow 142 when it is pressed against the second conveying rollers 416 by the rollers 424. However, if both the first conveying rollers 412 and the second conveying rollers 416 are made of a material having a relatively high coefficient of friction, they are always kept in contact with each other and therefore tend to wear out within a relatively short period of time.

Figure 14:
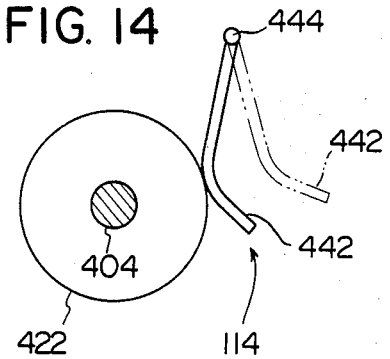
FIG. 14 is a partial sectional view showing a modified example of a pressing means in the second multifunctional conveying means.

FIG. 14 shows a modified example of the pressing means 114 to be pressed selectively against the third conveying rollers 422. In the modified example shown in FIG. 14, the pressing means 114 is composed of an elastic plate 442 which may be a metal plate or a synthetic resin plate. A rotatable shaft member 444 is fixed to the upper end portion of the elastic plate 442, and the elastic plate 442 is adapted to be selectively held at an operating position shown by a solid line and a non-operating position shown by a two-dot chain line by an actuating means (not shown) which may be an electromagnetic solenoid. At the operating position, the elastic plate 442 is pressed by the third conveying rollers 422, and at the non-operating position, the elastic plate 442 is set apart from the third conveying rollers 422.

Returning mechanism

Figure 15:
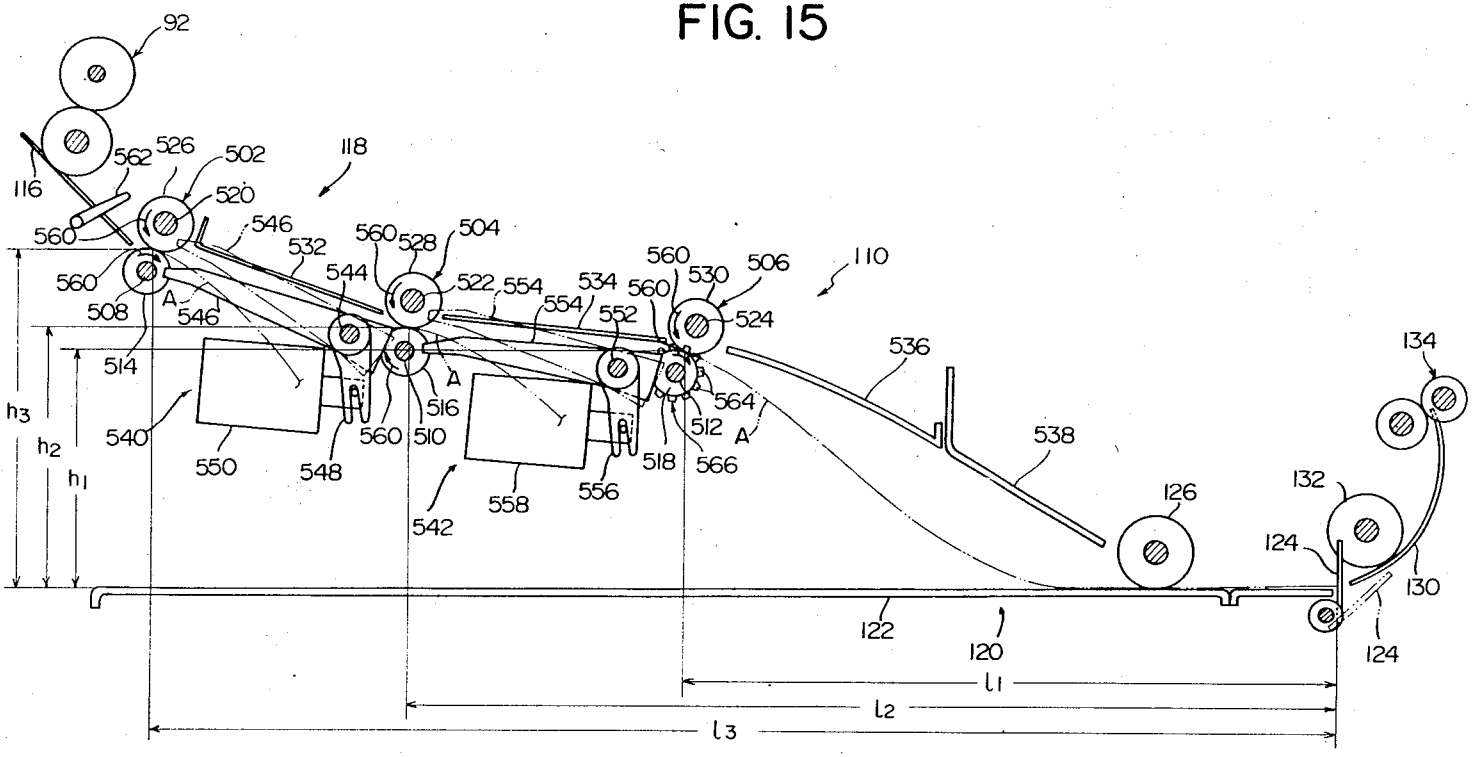
FIG. 15 is a partial sectional view showing a copying paper returning passage in the electrostatic copying apparatus of FIG. 1.

The returning mechanism 118 disposed in the paper returning passage 110 will be described in detail. With reference to FIG. 15, the illustrated returning mechanism 118 includes three returning roller pairs 502, 504 and 506 disposed in spaced-apart relationship in the returning direction of the copying paper. The returning roller pairs 502, 504 and 506 are respectively comprised of lower follower shafts 508, 510 and 512, a plurality of follower rollers 514, 516 and 518 fixed at suitable intervals to the shafts 508, 510 and 512 in the width direction (the direction perpendicular to the sheet surface in FIG. 15), upper driven shafts 520, 522 and 524 and a plurality of driven rollers 526, 528 and 530 fixed at suitable intervals to the shafts 520, 522 and 524 in the widthwise direction. The upper driven shafts 520, 522 and 524 are directly mounted on the lower front base plate 152 and the lower rear base plate 154 of the lower supporting frame 146, but the lower follower shafts 508, 510 and 512 are mounted on the movable frame 166 (see FIGS. 1 to 4 also).

A plurality of axially spaced upper guide plates 532 are disposed between the returning roller pairs 502 and 504, and a plurality of axially spaced upper guide plates 534 are disposed between the returning roller pairs 504 and 506. Furthermore, upper guide plates 536 and 538 are disposed downstream of the returning roller pair 506. The upper guide plates 532, 534, 536 and 538 are directly mounted between the lower front base plate 152 and the lower rear base plate 154 of the lower supporting frame 146 (see FIGS. 1 to 3 also).

A return controlling means shown generally at 540 is disposed between the returning roller pairs 502 and 504, and likewise a return controlling means shown generally at 542 is disposed between the returning roller pairs 504 and 506. The return controlling means 540 and 542 are mounted on the movable frame 166 (see FIGS. 1, 2 and 4 also). The illustrated return controlling means 540 includes a rotatably mounted supporting shaft 544 and a plurality of widthwise spaced return controlling members 546 fixed to the supporting shaft 544. A downwardly extending linking piece 548 is fixed to one end portion of the supporting shafts 544, and a moving means 550 comprised of an electromagnetic solenoid is connected to the lower end of the linking piece 548 (more specifically, a slot is formed in the linking piece 548, and pin is provided in the iron core of the electromagnetic solenoid, and the pin is inserted into the slot). When the moving means 550 is in the deenergized state, the return controlling members 546 are held at a guiding position shown by a solid line. At the guiding position, the upstream ends of the return controlling member 546 are located below the nipping site of the returning roller pair 502, and therefore, the copying paper delivered from the returning roller pair 502 is guided between the upper surfaces of the return controlling members 546 and the under surface of the upper guide plate 532 and led to the returning roller pair 504. On the other hand, when the moving means 550 is energized, the return controlling members 546 are held at a non-guiding position shown by a two-dot chain line. At the non-guiding position, the upstream ends of the return controlling members 546 are located above the nipping site of the returning roller pair 502, and therefore, the copying paper delivered from the returning roller pair 502 is not led to the returning roller pair 504 but is guided to the under surfaces of the return controlling members 546 and led directly to the receiving stand 122 of the paper re-sending means 120. The return controlling means 542 is of substantially the same structure as the return controlling means 540, and includes a rotatably mounted supporting shaft 552, a plurality of widthwise spaced return controlling members 554 fixed to the supporting shaft 552, a linking piece 556 fixed to one end portion of the supporting shaft 552 and a moving means 558 connected to the linking piece 556. When the moving means 558 is in the deenergized state, the return controlling members 554 are held at a guiding position shown by a solid line. At the guiding position, the upstream ends of the return controlling members 554 are located below the nipping site of the returning roller pair 504, and therefore, the copying paper delivered from the returning roller pair 504 is guided between the upper surfaces of the return controlling members 554 and the under surface of the upper guide plate 534 and led to the returning roller pair 506. On the other hand, when the moving means 558 is energized, the return controlling members 554 are held at a non-guiding position shown by a two-dot chain line. At the non-guiding position, the upstream ends of the return controlling members 554 are located above the nipping site of the returning roller pair 504, and therefore, the copying paper delivered from the returning roller pair 504 is not led to the returning roller pair 506, but is guided by the under surfaces of the return controlling members 554 and directly led to the receiving stand 122 of the paper re-sending means 120.

The aforesaid structure of the returning mechanism 118 is conventional. The conventional returning mechanism 118 has the following problem because it has only the aforesaid structure.

In the returning mechanism 118 described above, the return controlling members 546 of the return controlling means 540 and the return controlling members 554 of the return controlling means 542 are held at the guiding position or the non-guiding position according to the length in the moving direction of a copying apper to be returned to the paper re-sending means 120 via the paper returning passage 110. When the length of the copying paper in the moving direction is slightly shorter than the returning length of the copying paper from the nipping site of the returning roller pair 506 to the stopping means 124 at the operating position in the paper re-sending means 120, both the return controlling members 546 and the return controlling members 554 are held at the guiding positions shown by solid lines. Hence, the copying paper is conducted from the returning roller pair 502 to the returning roller pair 504 and further to the returning roller pair 506, and thereafter delivered to the paper re-sending means 120. When the returning length of the copying paper from the nipping site of the returning roller pair 504 to the stopping means 124 at the operating position in the paper re-sending means 120, the return controlling members 546 are held at the guiding position shown by the solid line, and the return controlling members 554 are held at the non-guiding positions shown by the two-dot chain line. Hence, the copying paper is conducted from the returning roller pair 502 to the returning roller pair 504, and thereafter without being led to the returning roller 506, is directly delivered to the paper re-sending means 120. When the length of the copying paper in the moving direction is slightly shorter than the returning length of the copying paper from the nipping site of the returning roller pair 502 to the stopping means 124 at the operating position in the paper re-sending means 120, both the return controlling members 546 and the return controlling members 554 are held at the non-operating positions shown by the two-dot chain lines, and therefore, the copying paper is directly delivered to the paper re-sending means 120 from the returning roller pair 502 without being led to the returning roller pair 504.

When the length of the copying paper in the moving direction falls into any of the three variations mentioned above, no problem arises in the paper returning passage 110. But troubles will occur in the returning of the copying paper when its length in the moving direction is slightly longer than the returning length of the paper from the nipping site of the returning roller pair 506 to the stopping means 124 at the operating position in the paper re-sending means 120 and considerably shorter than the paper returning length from the nipping site of the returning roller pair 504 to the stopping means 124 at the operating position in the paper re-sending means 120, or when it is slightly shorter than the paper returning length from the nipping site of the returning roller pair 504 to the stopping means 124 at the operating position in the paper re-sending means 120 and considerably shorter than the paper returning length from the nipping site of the returning roller pair 502 to the stopping means 124 at the operating position in the paper re-sending means 120, or when it is longer than the paper returning length from the nipping site of the returning roller pair 502 to the stopping means 124 at the operating position in the paper re-sending means 120.

Now, let us take up as an example the case where the length of the copying paper in the moving direction is slightly longer than the paper returning length from the nipping site of the returning roller pair 506 to the stopping means 124 at the operating position in the paper re-sending means 120 and considerably shorter than the paper returning length from the nipping site of the returning roller pair 504 to the stopping means 124 at the operating position in the paper re-sending means 120. When both the return controlling members 546 and the return controlling members 554 are held at the guiding positions shown by the solid lines, the copying paper is led to the returning roller pair 506 and then delivered to the paper re-sending means 120. But when the leading end of the copying paper has abutted against the stopping means 124, its trailing end portion is still nipped by the returning roller pair 506. The trailing end portion of the copying paper is delivered by the action of the returning roller pair 506 to be rotated in the direction shown by an arrow 560, but its leading end connot move forwardly because it is in abutment with the stopping means 124. Furthermore, since the copying paper itself has the desired stiffness, the trailing end portion of the copying paper is moved downstream of the nipping site of the returning roller pair 506, but as shown by a two-dot chain line A in FIG. 15, tends to remain in contact with the peripheral surface of the roller 518 of the returning roller pair 506 without being detached downwardly from the returning roller pair 506. When in this state the next copying paper is led to the returning roller pair 506, the trailing end portion of the preceding paper interferes with the leading end portion of the next copying paper, and for example, the leading end portion of the next copying paper may pass beneath the trailing end portion of the preceding copying paper. This is an unallowable situation. On the other hand, when an attempt is made to deliver the copying paper directly from the returning roller pair 504 to the paper re-sending means 120 without conducting it to the returning roller pair 506 by holding the return controlling members 546 at the guiding position shown by the solid line and the return controlling members 554 at the non-guiding position shown by the two-dot chain line, another unallowable situation is likely to occur. Specifically, when the trailing end of the copying paper has left the nipping site of the returning roller pair 504 and therefore no positive force tending to advance the copying paper acts on the copying paper, the leading end of the copying paper has not yet been nipped by the delivery roller 126 in the paper re-sending means 120. Hence, an unallowable situation may arise in which the forward movement of the copying paper on the stand 122 is stopped and the copying paper is not returned to the desired position, i.e. the position at which the leading end of the copying paper abuts against the stopping means 124 kept at the operating position.

Accordingly, in the conventional copying apparatus, when three returning roller pairs 502, 504 and 506 are provided, copying papers having lengths in the moving direction which fall only into the three variations mentioned above can be returned properly. In order to properly return copying papers having four or more lengths in the moving direction, it is necessary to provide four or more returning roller pairs in spaced-apart relationship in the returning direction and also returning direction controlling means among the returning roller pairs. Consequently, the number of component parts increases, and will lead to the increased cost of production and the increased size of the electrostatic copying apparatus.

In order to solve the above problem, in one aspect of this invention, at least one of the returning roller pairs 502, 504 and 506 is provided with a forced detaching means for forcibly and downwardly detaching the trailing end portion of the copying paper which has passed the nipping site of that roller pair.

With reference to FIG. 15, the forced detaching means is provided in each of the three returning roller pairs 502, 504 and 506. The forced detaching means for the returning roller pair 502 is constituted by the return controlling means 540 itself, and likewise, the return controlling means 542 constitutes the forced detaching means for the returning roller pair 506. However, the positionings of the return controlling members 546 in the return controlling means 540 and the return controlling members 554 in the return controlling means 542 differ from those in the prior art. In the prior art, when it is desired to deliver the copying paper directly to the paper re-sending means 120 from the returning roller pair 502 without conducting it to the returning roller pair 504, the return controlling members 546 remain held at the non-guiding position shown by the two-dot chain line. In contrast, in the illustrated embodiment improved in accordance with one aspect of this invention, when the length of the copying paper in the moving direction is slightly longer than the paper returning length from the nipping site of the returning roller pair 502 to the stopping means 124 at the operation position in the paper re-sending means 120 and therefore, as shown by the two-dot chain line A, the trailing end portion of the copying paper tends to be kept in contact with the peripheral surface of the roller 514 of the returning roller pair 502 without being detached downwardly from the returning roller pair 502, the moving means 550 is deenergized within a predetermined period of time from the time when the trailing end of the copying paper has passed the nipping site of the returning roller pair 502, namely before the leading end of the next copying paper has reached the nipping site of the returning roller pair 502, and consequently, the return controlling members 546 are moved to the guiding position shown by the solid line. As a result, as can be easily understood from FIG. 15, the return controlling members 546 moved to the guiding portion shown by the solid line from the non-guiding position shown by the two-dot chain line act on the trailing end of the copying paper kept in contact with the peripheral surface of the roller 514 and forcibly move it downwardly, and the trailing end portion of the copying paper is exactly detached downwardly from the returning roller pair 502. After that and before the leading end of the next copying paper reaches the nipping site of the returning roller pair 502, the moving means 550 is again energized and the return controlling members 546 are returned to the non-guiding position shown by the two-dot chain line. Accordingly, even when the length of the copying paper in the moving direction is slightly longer than the returning length of the copying paper from the nipping site of the returning roller pair 502 to the stopping means 124 at the operating position in the paper re-sending means 120, the copying paper can be returned as desired without causing any trouble. The time when to move the return controlling members 546 to the guiding position shown by the solid line and the time when to return them to the non-guiding position shown by the two-dot chain line can be controlled, for example, on the basis of the time when a copying paper detecting means 562 of any desired type disposed upstream of the returning roller pair 502 has detected the leading end (or the trailing end ) of the copying paper, the returning speed of the copying paper and the length of the copying paper in the moving direction (the length of the copying paper in the moving direction can be detected by determining from which paper cassette the copying paper has been fed).

Likewise, in the prior art, when it is desired to deliver the copying paper directly to the paper re-sending means 120 from the returning roller pair 504 without conducting it to the returning roller pair 506, the return controlling members 554 are kept at the non-guiding position shown by the two-dot chain line. In contrast, in the illustrated embodiment improved in accordance with one aspect of the present invention, when the length of the copying paper in the moving direction is slightly larger than the paper returning length from the nipping site of the returning roller pair 504 to the stopping means 124 at the operating position in the paper re-sending means 120 and therefore, as shown by the two-dot chain line A, the trailing end portion of the copying paper tends to be kept in contact with the peripheral surface of the roller 516 of the returning roller pair 504 without being detached downwardly from the returning roller pair 504, the moving means 558 is deenergized within a predetermined period of time from the time when the trailing end of the copying paper has passed the nipping site of the returning roller pair 504, namely before the leading end of the next copying paper reaches the nipping site of the returning roller pair 504, and consequently the return controlling members 554 are moved to the guiding position shown by the solid line. As a result, as can be easily understood by reference to FIG. 15, the return controlling members 554 moved to the guiding position shown by the solid line from the non-guiding position shown by the two-dot chain line act on the trailing end of the copying paper kept in contact with the peripheral surface of the roller 516 and forcibly move it downwardly, and thus, the trailing end portion of the copying paper is surely detached downwardly from the returning roller pair 504. After that and before the leading end of the next copying paper reaches the nipping site of the returning roller pair 504, the moving means 558 is again energized and the return controlling members 554 are returned to the non-guiding position shown by the two-dot chain line. Accordingly, even when the length of the copying paper is slightly larger than the paper returning length from the nipping site of the returning roller pair 504 to the stopping means 124 at the operating position in the paper returning means 120, the copying paper can be returned in the desired manner without causing any trouble.

Figure 16:
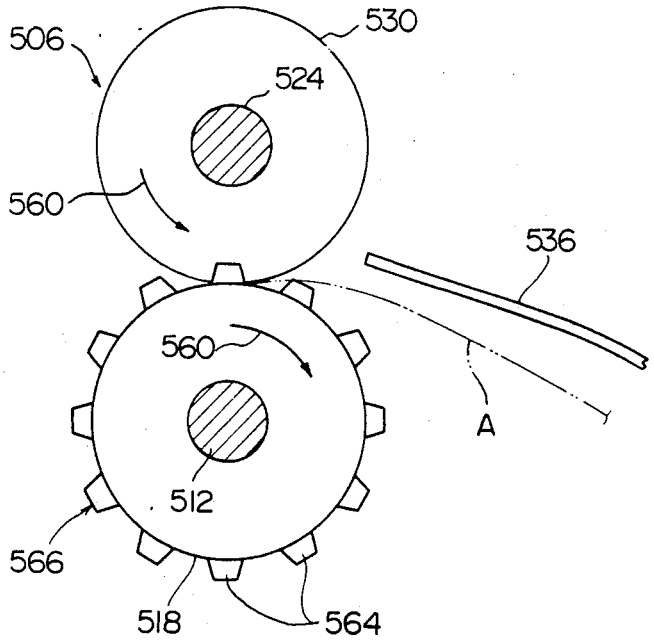
FIG. 16 is a partial sectional view of a forced detaching means in the paper returning passage shown in FIG. 15.
Figure 17:
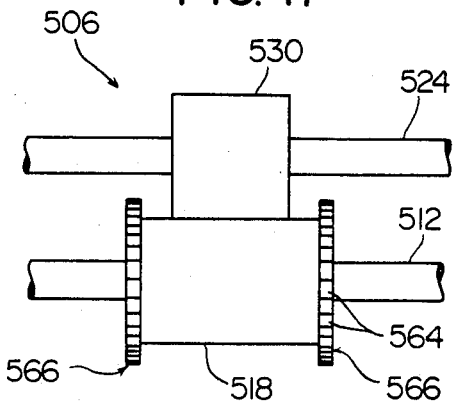
FIG. 17 is a partial side view showing a forced detaching means in the paper returning passage in FIG. 15.

Now, with reference to FIGS. 16 and 17 in conjunction with FIG. 15, the forced detaching means for the returning roller pair 506 will be described. As illustrated in FIG. 17, at least one of the lower rollers 518 in the returning roller pair 506 has a larger width than the corresponding upper roller 530, and at least one end portion (the two end portions in the illustrated embodiment of the lower roller 518) is projected widthwise beyond the end of the upper roller 530. It is necessary that the projecting end portion of the lower roller 518 should exist within the width of the copying paper which passes the returning roller pair 506. At least one, preferably a plurality of (12 in the illustrated embodiment) circumferentially spaced protrusions 564 are formed in the projecting end portion of the lower roller 518, and the protrusions 564 constitute the forced detaching means 566. The shape of each protrusions 564 is optional, and is for example, nearly trapezoidal as clearly shown in FIG. 16.

The operation of the forced detaching means 566 comprised of the protrusions 564 will be described. When as shown by the two-dot chain line A in FIGS. 15 and 16, the trailing end portion of the copying paper which has passed the nipping site of the returning roller pair 506 tends to contact the peripheral surface of the roller 518, the protrusion 564 immediately abut against the trailing end of the copying paper because the roller 518 is rotating in the direction shown by an arrow 560. Consequently, the trailing end of the copying paper is forcibly moved in the direction of arrow 560 as the roller 518 rotates. The trailing end portion of the copying paper is thus forcibly moved and accurately detached downwardly from the roller 518.

If desired, instead of using the return controlling means 540 and 542 as the forced detaching means for the returning roller pairs 502 and 504, the forced detaching means for the returning roller pairs 502 and 504 may be constructed of protrusions formed in the projecting end portions of the lower rollers 514 and 516 as is the case with the forced detaching means 566 for the returning roller pair 506.

On the other hand, as a forced detaching means for the returning roller pair 506, a forced detaching means 568 having substantially the same structure as the return controlling means 540 and 542 having regard to the returning rollers 502 and 504 may be provided. The forced detaching means 568 illustrated in FIG. 18 includes a rotatably mounted supporting shaft 570 and a plurality of widthwise spaced movable members 572 fixed to the supporting shaft 570. A downwardly extending linking piece 574 is fixed to one end portion of the supporting shaft 570, and a moving means 576 composed of an electromagnetic solenoid is connnected to the lower end of the linking piece 574. When the moving means 576 is in the deenergized state, the movable members 572 are at an elevated position shown by a solid line. When the moving means 576 is energized, the movable members 572 are held at a lowered position shown by a two-dot chain line. At the elevated position shown by the solid line, the upstream ends of the movable members 572 are located above the nipping site of the returning roller pair 506. At the lowered position shown by the two-dot chain line, the upstream ends of the movable members 572 are located below the nipping site of the returning roller pair 506.

In the forced detaching means 568 described above, the moving means 576 is normally deenergized and the movable members 572 are at the elevated position. In this case, the movable members 572 function simply as an upper guide member for preventing the copying paper delivered from the returning roller pair 506 from being biased upwardly (and therefore, in FIG. 18, the upper guide plate 536 in FIG. 15 is omitted). However, when the length of the copying paper in the moving direction is slightly larger than the paper returning length from the nipping site of the returning roller pair 506 to the stopping means 124 at the operating position in the paper re-sending means 120 and therefore as shown by the two-dot chain line A, the trailing end portion of the copying paper tends to be kept in contact with the peripheral surface of the roller 518 of the returning roller pair 506, the moving means 576 is energized within a predetermined period of time from the time when the trailing end of the copying paper has passed the nipping site of the returning roller pair 506, namely before the leading end of the next copying paper reaches the nipping site of the returning roller pair 506, and consequently the movable members 572 are moved to the lowered position shown by the two-dot chain line. Consequently, as can be easily undetstood by reference to FIG. 18, the movable members 572 moved to the lowered position shown by the two-dot chain line from the elevated position shown by the solid line act on the trailing end of the copying paper kept in contact with the peripheral surface of the roller 518 and forcibly move it downwardly, and thus the trailing end portion of the copying paper is accurately detached downwardly from the returning roller pair 506. After that and before the leading end of the next copying paper arrives at the nipping site of the returning roller pair 506, the moving means 576 is again deenergized and the movable members 572 are returned to the elevated position shown by the solid line. Accordingly, even when the length of the copying paper in the moving direction is slightly larger than the paper returning length from the nipping site of the returning roller pair 506 to the stopping means 124 at the operating position in the paper re-sending means 120, it can be returned as desired without causing any trouble.

Figure 18:
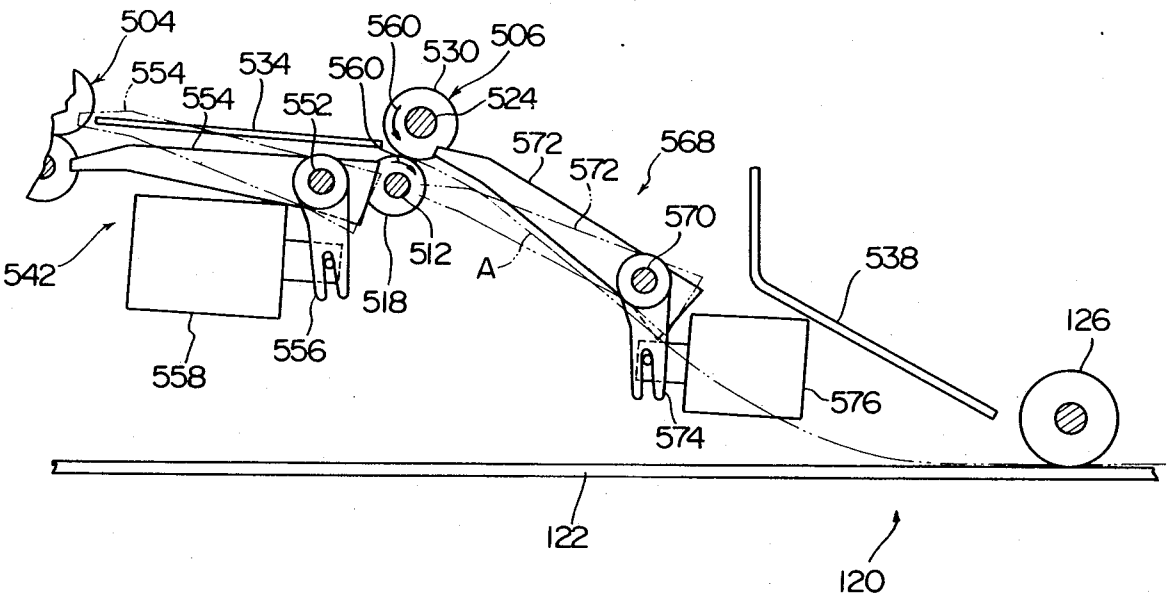
FIG. 18 is a partial sectional view showing a modified example of the forced detaching means in the paper returning passage in FIG. 15.

When the forced detaching means 568 illustrated in FIG. 18 is used, the moving means for the return controlling members 546 in the return controlling means 540 (concurrently acting as the forced detaching means), the moving means for the return controlling members 554 in the return controlling means 542 (concurrently acting as the forced detaching means), and the moving means for the movable means 572 in the forced detaching means 568 may be constructed of a common moving mechanism instead of providing the moving means 550, 558 and 576 respectively in the return controlling means 540 and 542 (FIG. 15) (concurrently acting as the forced detaching means) and the forced detaching means 568. In this alternative embodiment, it is necessary to reverse the positioning of the return controlling members 546 or 554 and the positioning of the movable members 572, namely to hold the movable members 572 at the elevated position when the return controlling members 546 or 554 are held at the guiding position, and hold the movable member 572 at the lowered position when the return controlling members 546 or 544 are held at the non-operating position. By so doing, the aforesaid return controlling action and the forced detaching action can be carried out in the desired manner.

If, in accordance with one aspect of this invention, the forced detaching means 540, 542 and 566 or 568 are annexed to at least one, preferably all, of the returning roller pairs 502, 504 and 506 in the returning mechanism 118, not only a copying paper having a length in the moving direction slightly smaller than the paper returning length from the nipping position of the returning roller pair 502, 504 or 506 to the stopping means 124 in the paper re-sending means 120, but also a copying paper having a slightly larger than the paper returning length, in other words a copying paper having a length in the moving direction slightly smaller than the paper returning length to a length in the moving direction slightly longer than the returning length, can be returned to the paper re-sending means 120 from the returning roller pairs 502, 504 and 506 without raising any problem.

Accordingly, the number of the lengths of the copying paper in the moving lengths which can be returned as desired can be increased greatly without increasing the number of the returning roller pairs 502, 504 and 506 in the returning mechanism 118 and the number of the return controlling means 540 and 542 among them and therefore without considerably increasing the cost of production and without increasing the size of the electrostatic copying apparatus. In other words, the number of the returning roller pairs 502, 504 and 506 in the returning mechanism 118 and the number of the return controlling means 540 and 542 among them corresponding to the number of the lengths in the moving direction of the copying paper that can be returned as desired can be decreased from those in the prior art, and the cost of production can be reduced and the size of the electrostatic copying apparatus can be decreased.

To take up one example, when in FIG. 15, $l_1$=about 220 mm, $l_2$=about 327 mm, $l_3$=about 413 mm, $h_1$=about 76 mm, $h_2$=about 87 mm and $h_3$=about 114 mm, not only papers having a length in the moving direction corresponding to the JIS B5 lateral size (182 mm), JIS A4 lateral size (21 cm and the international letter size (215.9 mm), but also papers having the JIS B5 longitudinal size (257 mm) can be returned through all of the returning roller pairs 502, 504 and 506. Furthermore, papers having a length in the moving direction corresponding to the international lateral letter size (279.4 mm), the JIS A-5 longitudinal size (297 mm) and the folio size (330 mm), but also copying papers having a length in the moving direction corresponding to the legal longitudinal size (355.6 mm) and the JIS B4 longitudinal size (364 mm) can be returned via the returning rollers 502 and 504 only. Furthermore, copying papers having a length in the moving direction corresponding to the JIS A-3 longitudinal size (420 mm) and 17 inches (431.8 mm) can be returned as desired via the returning roller pair 502 alone. In this example, the maximum length of the copying paper in the moving direction is limited to 17 inches (431.8 mm) because of a restriction attributed to the structure other than the paper returning passage 110. But in the paper returning passage 110 itself, a copying paper having a longer length in the moving direction can be returned as desired via the returning roller pair 502 alone.

While some specific embodiments of the electrostatic copying apparatus improved in accordance with the various aspects of the invention have been described in detail with reference to the accompaning drawings, it should be understood that the present invention is not limited to these specific embodiments, but various changes and modifications are possible without departing from the scope of the present invention.

What is claimed is:

1. An electrostatic copying apparatus of the type comprising a lower supporting frame, an upper supporting frame mounted on the lower supporting frame for free pivotal movement between an operating position and a nonoperating position, a copying paper conveying passage, a copying paper feeding means for feeding a copying paper sheet to the paper conveying passage and a copying paper returning passage, and being adapted to form an image on one surface of the copying paper sheet while it is conveyed through the paper conveying passage after being fed to the conveying passage from the feeding means, introduce the paper sheet bearing an image on one surface selectively into the paper returning message, return it through the returning passage, re-feed it into the paper conveying passage and to form an image on the other surface of the paper sheet while it is re-conveyed through the paper conveying passage, at least a greater portion of the paper conveying passage being defined between the lower supporting frame and the upper supporting frame when the upper supporting frame is held at the operating position and being opened when the upper supporting frame is held at the non-operating position, and at least a greater portion of the paper returning passage being provided inside the lower supporting frame; wherein a lower front cover member is mounted on the lower supporting frame so that it is free to move between a closed position at which it covers at least a greater part of the front surface of the lower supporting frame and an open position at which said front surface is open, and for removal of copying paper which has jammed up in the paper returning passage, the lower front cover member should be at the open position, and a locking means for the lower front cover member is provided which prevents the lower front cover member from being moved to the open position from the closed position when the upper supporting frame is at the operating position, and which permits the lower front cover member to be moved to the open position from the closed position when the upper supporting frame is pivoted to the non-operating position from the operating position.

2. The apparatus of claim 1 wherein said locking means is comprised of a restraining member provided in one of the upper supporting frame and the lower front cover member and a restrained member provided in the other of the upper supporting frame and the lower front cover member; and wherein when the lower front cover member is at the closed position and the upper supporting frame is at the operating position, the restraining member restrains the restrained member whereby the lower front cover member is prevented from being moved to the open position from the closed position, and when the upper supporting frame is pivoted to the non-operating position from the operating position, the restraining member and the restrained member are moved away from each other.

3. The apparatus of claim 1 wherein the lower front cover member is free to pivot between the closed position and the open position about a pivot axis extending along its lower edge as a center.

4. The apparatus of claim 1 wherein an upper front cover member is mounted on the upper supporting frame such that it is free to move between a closed position at which it covers at least a greater portion of the front surface of the upper supporting frame and an open position at which said front surface is open.

5. The apparatus of claim 4 wherein the upper front cover member is free to pivot between the closed position and the open position about a pivot axis extending along its lower edge as a center.

6. The apparatus of claim 1 which further comprises a detecting means for detecting the fact that the lower front cover member is at the closed position and the upper supporting frame is at the operating position.

7. The apparatus of claim 6 wherein the detecting means is comprised of a detecting element provided in one of the upper supporting frame and the lower front cover member and a detected element provided in the other of the upper supporting frame and the lower front cover member, and when the upper supporting frame is at the operating position and the lower front cover member is at the closed position, the detecting element detects the detected element.

8. The apparatus of claim 7 wherein said locking means is comprised of a restraining member provided in one of the upper supporting frame and the lower front cover member and a restrained member provided in the other of the upper supporting frame and the lower front cover member, and when the lower front cover member is at the closed position and the upper supporting frame is at the operating position, the restraining member restrains the restrained member whereby the lower front cover member is prevented from being moved to the open position from the closed position; when the upper supporting frame is pivoted to the non-operating position from operating position, the restraining member and the restrained member are moved away from each other; and the restrained member of the locking means and the detected member of the detecting means are comprised of a common member.

9. The apparatus of claim 1 which further comprises a copying paper re-feeding passage and a copying paper re-sending means for receiving a copying paper sheet returned via the paper returning passage and re-feeding the received copying paper sheet to the paper conveying passage through the paper re-feeding passage, and in which at least a greater portion of the paper re-feeding passage and the paper re-sending means are provided inside the lower supporting frame, and the lower front cover member should be held at the open position to remove a copying paper that has jammed up in the paper re-feeding passage and a copying paper that has jammed up in the paper re-sending means.

10. The apparatus of claim 9 wherein the lower supporting frame includes a lower front base plate and a lower rear base plate spaced from each other in the forward-backward direction, at least a greater part of the paper returning passage, at least a greater part of the paper re-feeding passage, and the paper re-sending means are provided between the lower front base plate and the lower rear base plate, and a single opening is formed in the lower front base plate which extends at least over a region where at least a greater part of the paper returning passage and the paper re-sending means exist.

11. The apparatus of claim 10 wherein at least a greater part of the paper returning passage is defined between a plurality of upper elements and a plurality of lower elements, the plurality of upper elements are mounted between the lower front base plate and the lower rear base plate, a movable frame is mounted on the lower rear base plate for free movement between an operating position and a non-operating position, the plurality of lower elements are mounted on the movable frame, and at least a greater part of the paper returning passage is defined when the movable frame is at the operating position, and at least a greater part of the paper returning passage is opened when the movable frame is held at the non-operating position, and the opening formed in the lower front base plate extends not only to the operating position of the movable frame but also to its non-operating position.

12. The apparatus of claim 11 wherein the movable frame is mounted on the lower rear base plate for free pivotal movement between the operating position and the non-operating position about a pivot axis extending along its rear edge as a center.

13. An electrostatic copying apparatus of the type comprising a lower supporting frame, an upper supporting frame mounted on the lower supporting frame for pivotal movement between an operating position and a nonoperating position, a copying paper conveying passage, a copying paper feeding means for feeding a copying paper sheet to the paper conveying passage, a conveyance controlling means disposed adjacent to the downstream end of the paper conveying passage, a copying paper discharging passage extending from its upstream end adjacent to the downstream end of the conveyance controlling means, a copying paper reversing passage extending from its upstream end adjacent to the downstream end of the conveyance controlling means, and a copying paper returning passage extending from its upstream end adjacent to the upstream end of the conveyance controlling means, said conveyance controlling means including a lower movable guide member and an upper movable guide member defining a copying paper moving passage therebetween and said lower movable guide member and said upper movable guide member being adapted to be selectively held at a first position at which they permit communication between the downstream end of the paper conveying passage and the upstream end of the paper discharging passage and a second position at which they permit communication between the downstream end of the paper conveying passage and the upstream end of the paper reversing passage and also communication between the upstream end of the paper reversing passage and the upstream end of the paper returning passage, and of the type being adapted to form an image on one surface of a copying paper sheet while it is conveyed through the paper conveying passage after being fed into the paper conveying passage from the paper feeding means, introduce the copying paper sheet bearing an image on one surface into the paper discharging passage through the paper moving passage between the lower movable member and the upper movable member held at the first position, and to discharge it through the paper discharging passage, or to introduce the copying paper sheet bearing an image on one surface into the paper reversing passage through the paper movement passage between the lower movable guide member and the upper movable guide member held at the second position, reverse the moving direction of the copying paper sheet after its trailing end has passed the downstream end of the paper conveying passage, introduce the copying paper sheet into the paper returning passage, re-feed it into the paper conveying passage after being returned through the paper returning passage, form an image on the other surface of the copying paper sheet while being re-conveyed through the paper conveying passage, then introduce it into the paper discharging passage through the paper moving passage between the lower movable guide member and the upper movable guide member held at the first position, and then to discharge it through the paper discharging passage; wherein at least a greater part of the paper conveying passage is defined between the lower supporting frame and the upper supporting frame when the upper supporting frame is held at the operating position and is opened when the upper supporting frame is held at the non-operating position, the paper reversing passage is provided inside the upper supporting frame, and the paper returning passage is provided inside the lower supporting frame.

14. The apparatus of claim 13 wherein the paper discharging passage is defined between the lower supporting frame and the upper supporting frame when the upper supporting frame is held at the operating position, and is opened when the upper supporting frame is held at the non-operating position.

15. The apparatus of claim 13 wherein the lower movable guide member is mounted on the lower supporting frame and the upper movable guide member is mounted on the upper supporting frame, and wherein when the upper supporting frame is held at the non-operating position, the paper moving passage between the lower movable guide member and the upper movable guide member is opened.

16. The apparatus of claim 15 wherein one of the upper movable guide member and the lower movable guide member is biased to said first position or said second position, the other of the upper movable guide member and the lower movable guide member has annexed thereto an actuating means for selectively holding it at the first position or the second position, and the other of the upper movable guide member and the lower movable guide member has formed an abutting means therein and said one of the upper movable member and the lower movable member has formed therein an abutment means and when said other of the upper movable guide member and the lower movable guide member is moved from said one of the first position and the second position to the other, the abutting means acts on the abutment means to move forcibly said one of the upper movable guide member and the lower movable guide member to said other of the first position and the second position.

17. The apparatus of claim 16 wherein when said other of the upper movable guide member and the lower movable guide member is at said one of the first position and the second position, the abutting means abuts against the abutment means to restrict said one of the upper movable guide member and the lower movable guide member to said one of the first position and the second position.

18. The apparatus of claim 17 wherein a restricting means is provided in one of the upper supporting frame and the lower supporting frame, and even when the upper supporting frame is held at the non-operating position, the abutment of said one of the upper movable guide member and the lower movable member against the restricting means hampers the movement of said one of the upper movable guide member and the lower movable guide member beyond a predetermined restriction position.

19. The apparatus of claim 16 wherein an elastic means for elastically biasing the upper movable guide member toward the first position is provided between said one of the upper movable guide member and the lower movable guide member and said one of the upper supporting frame and the lower supporting frame.

20. The apparatus of claim 16 wherein the actuating means is comprised of an electromagnetic solenoid, and when the solenoid is deenergized, said other of the upper movable guide member and the lower movable guide member is held at said one of the first position and the second position, and when the electromagnetic solenoid is energized, said other of the upper movable guide member and the lower movable guide member is held at said other of the first position and the second position.

21. The apparatus of claim 13 wherein the lower movable guide member and the upper movable guide member are formed as a one-piece unit, and are mounted on one of the lower supporting frame and the upper supporting frame.

* * * * *